US010934124B2

(12) United States Patent
Baek et al.

(10) Patent No.: US 10,934,124 B2
(45) Date of Patent: Mar. 2, 2021

(54) STAPLING APPARATUS AND IMAGE FORMING APPARATUS INCLUDING THE SAME

(71) Applicant: HEWLETT-PACKARD DEVELOPMENT COMPANY, L.P., Spring, TX (US)

(72) Inventors: Tae-jin Baek, Suwon-si (KR); Tae-hong Kim, Suwon-si (KR); Seoung-uk Han, Suwon-si (KR); Eiji Fukasawa, Suwon-si (KR); Dong-sun Jung, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 50 days.

(21) Appl. No.: 16/388,171

(22) Filed: Apr. 18, 2019

(65) Prior Publication Data

US 2019/0241394 A1 Aug. 8, 2019

Related U.S. Application Data

(63) Continuation of application No. PCT/KR2017/009860, filed on Sep. 8, 2017.

(30) Foreign Application Priority Data

Oct. 20, 2016 (KR) ..... 10-2016-0136195

(51) Int. Cl.

| | |
|---|---|
| ***B65H 37/04*** | (2006.01) |
| ***B42C 1/12*** | (2006.01) |
| ***B31F 5/00*** | (2006.01) |
| ***B41L 43/12*** | (2006.01) |
| ***B27F 7/23*** | (2006.01) |
| ***G03G 15/00*** | (2006.01) |

(52) U.S. Cl.

CPC ..... *B65H 37/04* (2013.01); *B27F 7/23* (2013.01); *B31F 5/001* (2013.01); *B41L 43/12* (2013.01); *B42C 1/12* (2013.01); *G03G 15/6544* (2013.01); *B65H 2408/122* (2013.01); *B65H 2408/1222* (2013.01); *B65H 2408/1223* (2013.01); *G03G 2215/00827* (2013.01); *G03G 2215/00848* (2013.01); *G03G 2215/00864* (2013.01)

(58) Field of Classification Search

CPC ..... B65H 37/04; B65H 2408/122; B65H 2408/1222; G03G 2215/00827; G03G 2215/00848; G03G 2215/00864; B42C 1/12; B31F 5/001; B41L 43/12

USPC ..... 270/37, 58.08, 58.09; 410/399

See application file for complete search history.

(56) References Cited

U.S. PATENT DOCUMENTS

| | | | |
|---|---|---|---|
| 5,911,414 | A | 6/1999 | Kato et al. |
| 6,164,511 | A | 12/2000 | Chung et al. |
| 6,264,189 | B1 | 7/2001 | Kawata |

(Continued)

FOREIGN PATENT DOCUMENTS

| | | |
|---|---|---|
| CN | 1610605 | 4/2005 |
| JP | 2002273705 | 9/2002 |

(Continued)

*Primary Examiner* — Leslie A Nicholson, III

(74) *Attorney, Agent, or Firm* — Staas & Halsey LLP

(57) ABSTRACT

A stapling apparatus includes a stapler, a driver to move the stapler, and a guide part to define a moving path along which the stapler is to move in response to selection of the moving path among a plurality of moving paths along which the stapler is movable.

15 Claims, 28 Drawing Sheets

(56) References Cited

U.S. PATENT DOCUMENTS

| | | | |
|---|---|---|---|
| 6,427,997 | B1 | 8/2002 | Hirota et al. |
| 6,474,633 | B1 | 11/2002 | Hirai |
| 7,419,150 | B2 | 9/2008 | Kushida et al. |
| 8,517,368 | B1 | 8/2013 | Brundige et al. |
| 2005/0051589 | A1 | 3/2005 | Noh et al. |
| 2011/0031675 | A1 | 2/2011 | Terao |
| 2012/0037685 | A1 | 2/2012 | Jung |
| 2015/0368061 | A1 | 12/2015 | Lee et al. |
| 2017/0233213 | A1 | 8/2017 | Ahn |

FOREIGN PATENT DOCUMENTS

| | | |
|---|---|---|
| KR | 102012001562 | 2/2012 |
| WO | WO-2003038530 | 5/2003 |

STAPLING APPARATUS AND IMAGE FORMING APPARATUS INCLUDING THE SAME

CROSS-REFERENCE TO RELATED APPLICATIONS

This application is a continuation application of PCT international patent application no. PCT/KR2017/009860, filed on Sep. 8, 2017, which claims priority from Korean Patent Application No. 10-2016-0136195, filed on Oct. 20, 2016 in the Korean Intellectual Property Office, the disclosure of each of the foregoing is incorporated herein by reference.

BACKGROUND

An image forming apparatus refers to an apparatus that prints images on printing media on the basis of an input image signal through an image former, and may be a printer, a copier, a scanner, a facsimile, or the like, or may be a multi-functional peripheral (MFP) in which functions of the printer, the copier, the scanner, and the facsimile are complexly implemented through one apparatus.

An image forming apparatus may include a stapling apparatus that staples printing media on which formation of the images is completed through a stapler, a binding apparatus that bind the printing media in a book form by folding central portions of the printing media, and the like, for convenience of a user, to post-process the printing media on which the formation of the images are completed. The stapling apparatus or the binding apparatus may be included in a post-processing apparatus and be coupled to a body of the image forming apparatus.

DETAILED DESCRIPTION

Figure 1:
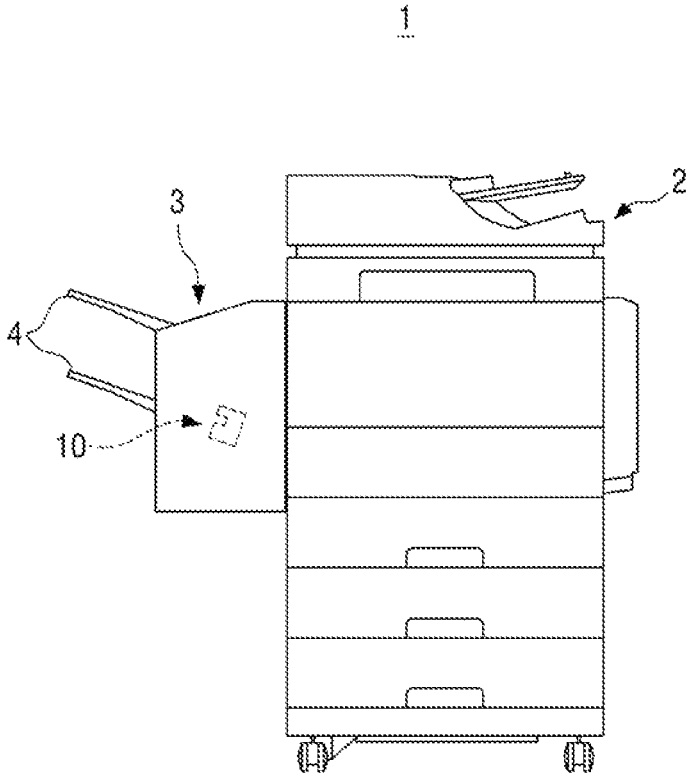
FIG. 1 is a view schematically illustrating an image forming apparatus including a stapling apparatus according to an example.

In the stapling apparatus according to the related art, a position of the stapler is fixed, such that stapling is performed on specific positions of the printing media discharged from the image former, and the stapler moves along a predetermined path, such that the stapling may be performed on different positions of the printing media.

However, in the stapling apparatus according to the related art, a moving path of the stapler is limited, such that stapling may not be performed on positions of various kinds of printing media having various sizes.

Hereinafter, examples of the disclosure will be described in detail with reference to the accompanying drawings. Examples to be described below will be described on the basis of examples most appropriate for understanding technical features of the disclosure, and these examples do not limit the technical features of the disclosure.

Therefore, the disclosure may be variously modified without departing from the technical scope of the, and these modifications will be to fall within the technical scope of the disclosure. In addition, to assist in the understanding of examples to be described below, components performing the same operations and related components in the respective examples will be denoted by the same or similar reference numerals throughout the accompanying drawings.

FIG. 1 is a view schematically illustrating an image forming apparatus 1 including a stapling apparatus 10 according to an example.

The image forming apparatus 1 according to an example may be a printer, a copier, a scanner, a facsimile, or the like, or may be a multi-functional peripheral (MFP) in which functions of the printer, the copier, the scanner, and the facsimile are complexly implemented through one apparatus. Hereinafter, a case in which the image forming apparatus 1 is the MFP will be described by way of example for convenience of explanation.

The image forming apparatus 1 may include a body 2 and a post-processing apparatus 3 coupled to the body.

The post-processing apparatus may perform post-processing such as stapling of printing media (not illustrated) on which formation of images is completed through a stapler, binding of the printing media in a book form by folding of central portions of the printing media, or the like, and may load the printing media on which the post-processing is completed in a plurality of trays 4.

As illustrated in FIG. 1, the post-processing apparatus 3 may include the stapling apparatus 10.

The stapling apparatus 10 may staple the printing media on which images are formed through an image former of the body 2. Here, the stapling refers to weaving and fixing a plurality of printing media through a staple such as a staple formed of a metal.

Figure 2:
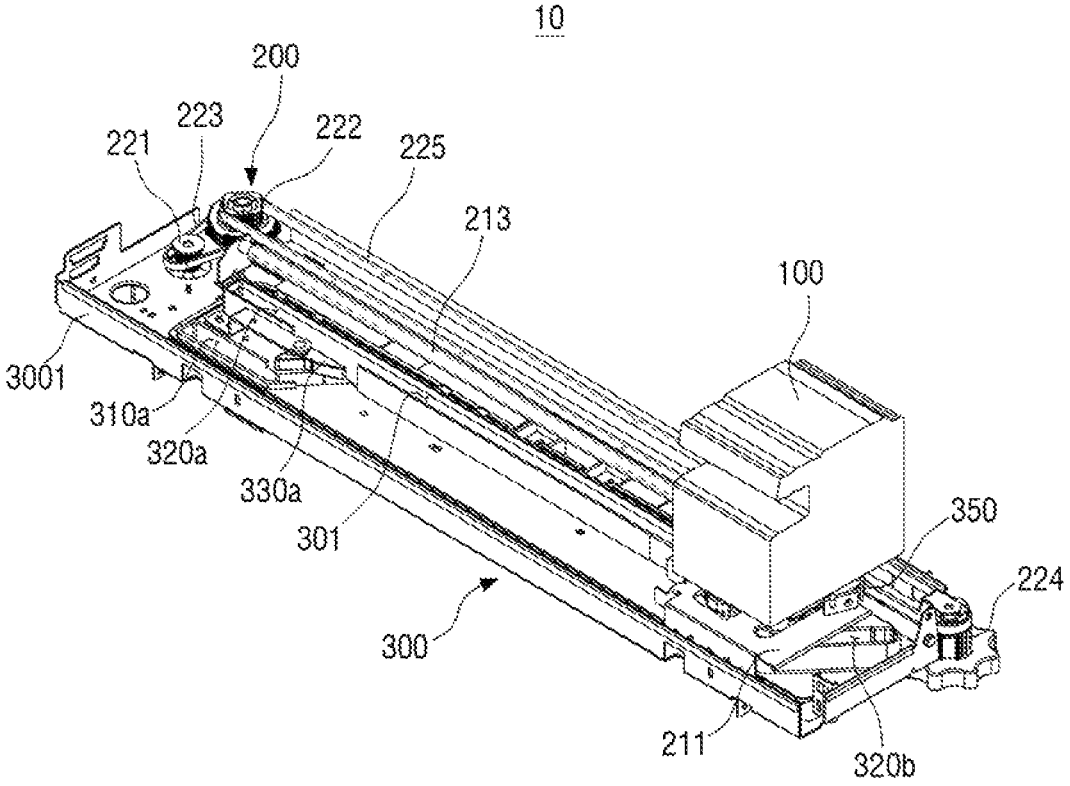
FIG. 2 is a perspective view illustrating the stapling apparatus illustrated in FIG.
Figure 3:
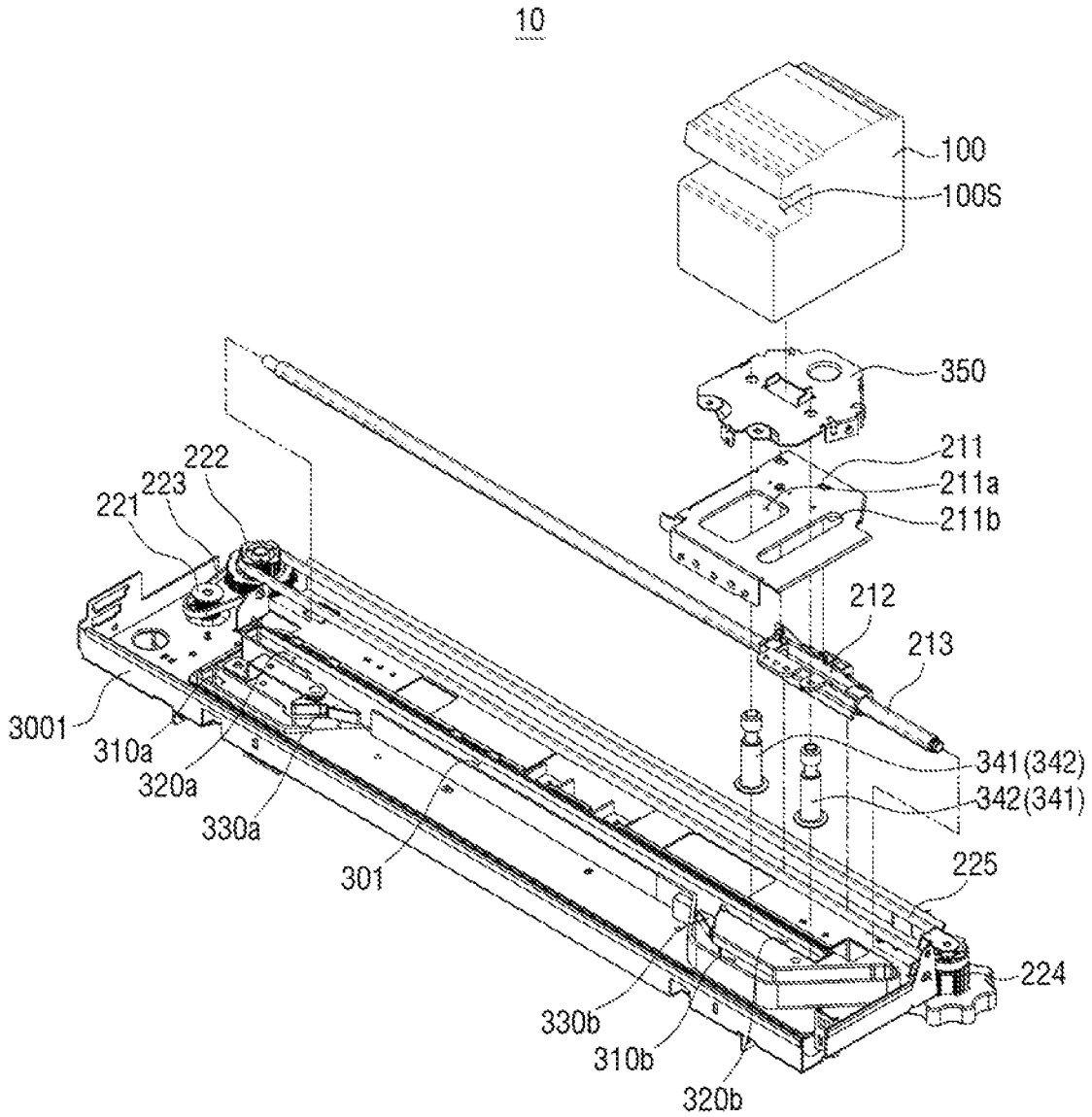
FIG. 3 is an exploded perspective view of the stapling apparatus illustrated in FIG. 2.

FIG. 2 is a perspective view illustrating the stapling apparatus 10 schematically illustrated in FIG. 1, and FIG. 3 is an exploded perspective view of the stapling apparatus 10 illustrated in FIG. 2.

Hereinafter, a structure of the stapling apparatus 10 will be described in detail with reference to FIGS. 2 and 3.

The stapling apparatus 10 may include a stapler 100, a driver 200 coupled to the stapler 100 and moving the stapler 100, and a guide part 300 selectively switching a moving path of the stapler 100.

The stapler 100 may staple a printing medium disposed in a stapling groove 100S, and may be electronically controlled through a controller (not illustrated) to move to a position and then staple the printing medium.

However, since the stapler 100 is the same as or similar to a stapler generally widely used in the post-processing apparatus 3, a detailed description therefor will be omitted.

The stapler 100 may be coupled to the driver 200 and move in a horizontal direction through the driver 200, and the moving path of the stapler 100 may be selectively switched through the guide part 300.

The driver 200 may include a moving plate 211, a moving member 212, a moving shaft 213, a first pulley 221, a second pulley 222, a first driving belt 223, a third pulley 224, a second driving belt 225, and a driving motor (not illustrated).

In detail, the moving plate 211 is coupled to the stapler 100.

In detail, the moving member 212 slidably coupled to the moving shaft 213 extended in the horizontal direction of the stapling apparatus 10 is coupled to the moving plate 211 coupled to the stapler 100.

The first pulley 221 is coupled to and rotates by the driving motor, and the first pulley 221 and the second pulley 222 are connected to each other through the first driving belt 223, such that torque of the first pulley 221 may be transferred to the second pulley 222.

In addition, the second pulley 222 and the third pulley 224 are disposed, respectively, at opposite ends of the stapling apparatus 10 in the horizontal direction, and are connected to each other through the second driving belt 225.

Therefore, the second driving belt 225 may rotate in the horizontal direction of the stapling apparatus 10.

The moving member 212 may be coupled to the second driving belt 225, and move in the horizontal direction depending on rotation of the second driving belt 225.

In addition, the moving member 212 may be slidably coupled to the moving shaft 213 to stably move along the moving shaft 213.

For example, it may be that the moving shaft 213 and the second driving belt 225 are disposed in parallel with each other in the horizontal direction of the stapling apparatus 10.

Therefore, the moving plate 211 coupled to the moving member 212 may reciprocate in the horizontal direction of the stapling apparatus 10, and the stapler 100 coupled to the moving plate 211 may reciprocate in the horizontal direction of the stapling apparatus 10.

In addition, the moving plate 211 is coupled to the moving member 212 fastened to the moving shaft 213 and slides along the moving shaft 213 and moves in the horizontal direction, such that the stapler 100 may stably move without being shaken.

In addition, an operation of the driving motor is controlled through the controller, such that a position of the stapler 100 may be manipulated.

A structure of the driver 200 may be modified into various structures that may move the stapler 100 in the horizontal direction of the stapling apparatus 10, in addition to the structure described above.

The guide part 300 may include a guide plate 3001, and a slot guiding movement of the stapler 100 is formed in the guide plate 3001.

As illustrated in FIGS. 2 and 3, the guide plate 3001 may have a quadrangular plate shape, and the driver 200 may be disposed on the guide plate 3001.

The guide plate 3001 may include a main slot 301 formed at the center thereof, and first branch slots 310*a* and 310*b* and second branch slots 320*a* and 320*b* branched from one end portion of the main slot 301.

The main slot 301 may be extended in the horizontal direction of the stapling apparatus 10 like the moving shaft 213, and the first branch slots 310*a* and 310*b* and the second branch slots 320*a* and 320*b* may be branched from one end portion of the main slot 301 at various angles and in various directions.

The first and second branch slots may be branched from one position of the main slot 301, such that the number of each of first and second branch slots may be one, or the first and second branch slots may be branched from several position of the main slot 301, such that the number of each of first and second branch slots may be plural.

For example, as illustrated in FIGS. 2 and 3, the first branch slots 310*a* and 310*b* and the second branch slots 320*a* and 320*b* may be branched from opposite sides of the main slot 310, respectively. In detail, the first and second branch slots 310*a* and 320*a* may be branched from one end portion of the main slot 301, and the first and second branch slots 310*b* and 320*b* may be branched from the other end portion of the main slot 301.

Figure 4:
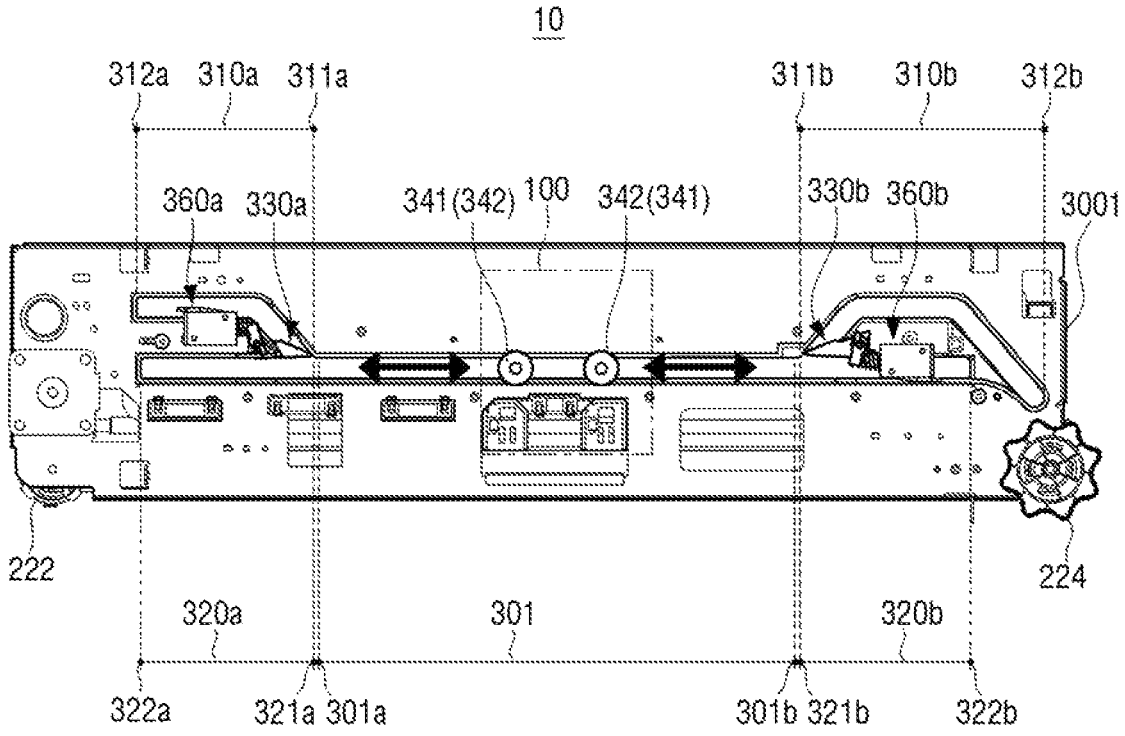
FIG. 4 is a bottom view of the stapling apparatus illustrated in FIG. 2.

In addition, the first and second branch slots 310*a* and 320*a* branched from one end portion of the main slot 301 and the first and second branch slots 310*b* and 320*b* branched from the other end portion of the main slot 301 may be disposed symmetrically to each other in the same shape, or be configured in different shapes as illustrated in FIG. 4 to be described below.

The guide part 300 may include switching levers 330*a* and 330*b* selectively opening or closing the first branch slots 310*a* and 310*b* and the second branch slots 320*a* and 320*b*.

The switching levers 330*a* and 330*b* may be rotatably coupled to the guide plate 3001 and rotate to selectively open or close the first branch slots 310*a* and 310*b* and the second branch slots 320*a* and 320*b*. Therefore, the moving path of the stapler 100 moving along the main slot 301, the first branch slots 310*a* and 310*b*, and the second branch slots 320*a* and 320*b* may be selectively switched.

In addition, the guide part 300 may include a roller slidably inserted into the main slot 301 and moving along the main slot 301.

The roller may include first and second rollers 341 and 342 as illustrated in FIGS. 2 and 3 or may be a single roller.

Hereinafter, for convenience of explanation, a roller disposed at the front in the moving direction of the stapler 100, of the first and second rollers 341 and 342, will be referred to as a first roller 341, and a roller disposed at the rear in the moving direction of the stapler 100, of the first and second rollers 341 and 342, will be referred to as a second roller 342.

Since the stapler 100 may reciprocate in the horizontal direction of the stapling apparatus 10, names of the first roller 341 and the second roller 342 may be exchanged with each other depending on the moving direction of the stapler 100.

One end portions of the first and second rollers 341 and 342 may be coupled to the stapler 100 and the other end portions thereof may be inserted into the main slot 301 to move along the main slot 301, the first branch slots 310*a* and 310*b*, and the second branch slots 320*a* and 320*b*.

The first and second rollers 341 and 342 may move in the horizontal direction of the stapling apparatus 10 by the driver 200 moving the stapler 100.

As illustrated in FIG. 3, the moving plate 211 coupled to the moving member 212 may include first and second hollows 211*a* and 211*b* formed therein.

One end portions of the first and second rollers 341 and 342 may penetrate through the first and second hollows 211*a* and 211*b*, respectively, and be then coupled to the stapler 100.

In addition, the first and second rollers 341 and 342 and the stapler 100 may be coupled to each other through a connection plate 350 disposed therebetween. In detail, one end portions of the first and second rollers 341 and 342 are coupled to the connection plate 350, and the connection plate 350 is coupled to the stapler 100, such that the first and second rollers 341 and 342 and the stapler 100 may be coupled to each other.

The first and second hollows 211*a* and 211*b* may have diameters greater than those of the first and second rollers 341 and 342 so that the first and second rollers 341 and 342 may move in the first and second hollows 211*a* and 211*b*, respectively.

Therefore, the first and second rollers 341 and 342 connected to the moving plate 211 and moving in the horizontal direction may also move in a vertical direction along the first branch slots 310*a* and 310*b* and the second branch slots 320*a* and 320*b*, and the stapler 100 may also move in the vertical direction, in addition to the horizontal direction.

In addition, the stapler 100 coupled to the first and second rollers 341 and 342 may rotate while moving along the first branch slots 310*a* and 310*b* and the second branch slots 320*a* and 320*b* by the first and second rollers 341 and 342 moving in the first and second hollows 211*a* and 211*b*.

Therefore, the main slot 301 may be extended to various paths through the first branch slots 310*a* and 310*b* and the second branch slots 320*a* and 320*b*, and the moving path of the stapler 100 that may move along the main slot 301, the first branch slots 310*a* and 310*b*, and the second branch slots 320*a* and 320*b* may be diversified.

A structure in which the moving path of the stapler 100 is selectively switched along the main slot 301, the first branch slots 310*a* and 310*b*, and the second branch slots 320*a* and 320*b* will be described in detail below.

FIG. 4 is a bottom view of the stapling apparatus 10 illustrated in FIG. 2.

Hereinafter, structures of the main slot 301, the first branch slots 310*a* and 310*b*, the second branch slots 320*a* and 320*b*, and the switching levers 330*a* and 330*b* will be described with reference to FIG. 4.

In FIG. 4, the stapler 100 disposed on a rear surface of the guide plate 3001 is denoted by a dotted line.

As illustrated in FIG. 4, the first branch slot 310*a* branched from one end portion 301*a* of the main slot 301 may be branched in an inclined form from one end portion 301*a* of the main slot 301. Therefore, the first and second rollers 341 and 342 pass through an inclined section of the first branch slot 310*a*, such that the stapler 100 may rotate at a predetermined angle.

In addition, the first branch slot 310*a* may include at least one bent section.

In detail, the first branch slot 310*a* may include the inclined section formed from one end portion 311*a* thereof connected to one end portion 301*a* of the main slot 301 and the bent section formed after the inclined section to again move the first and second rollers 341 and 342 in the horizontal direction.

Therefore, the stapler 100 passing through the first branch slot 310*a* may rotate at a predetermined angle while passing through the inclined section, and may then again rotate to correspond to the horizontal direction of the stapling apparatus 10 while passing through the bent section.

In addition, the second branch slot 320*a* is formed on the same straight line as that of the main slot 301.

In detail, the second branch slot 320*a* may be extended from one end portion 301*a* of the main slot 301 in the horizontal direction. Therefore, the main slot 301 may be extended from one end portion 321*a* of the second branch slot 320*a* to the other end portion 322*a* thereof.

A moving distance of the stapler 100 in the horizontal direction may be increased through the second branch slot 320*a*. Therefore, a distance at which stapling may be performed in the horizontal direction may be expanded. Therefore, the stapling may be performed on printing media having various sizes as compared with the related art.

In addition, the guide part 300 may further include the first branch slot 310*b* and the second branch slot 320*b* branched from the other end portion 301*b* of the main slot 301 opposed to one end portion 301*a* of the main slot 301.

The first branch slot 310*b* branched from the other end portion 301*b* of the main slot 301 may also be branched in an inclined form from the other end portion 301*b* of the main slot 301 like the first branch slot 310*a* branched from one end portion 301*a* of the main slot 301.

Therefore, the first and second rollers 341 and 342 pass through an inclined section of the first branch slot 310*b*, such that the stapler 100 may rotate. Therefore, an angle at which the stapling is performed on the printing medium may be changed.

In addition, as illustrated in FIG. 4, the first branch slot 310*b* branched from the other end portion 301*b* of the main slot 301 may include a plurality of bent sections disposed on a path from one end portion 311*b* of the first branch slot 310*b* to the other end portion 312*b* thereof.

Therefore, a position and an angle of the stapler 100 moving along the first branch slot 310*b* may be more variously adjusted.

In addition, the second branch slot 320*b* branched from the other end portion 301*b* of the main slot 301 may be formed on the same straight line as that of the main slot 301 like the second branch slot 320*a* branched from one end portion 301*a* of the main slot 301.

Therefore, the second branch slot 320*b* may be extended from the other end portion 301*b* of the main slot 301 in the horizontal direction, and the main slot 301 may be extended from one end portion 321*b* of the second branch slot 320*b* to the other end portion 322*b* thereof.

As described above, the first and second branch slots branched from the main slot 301 may be branched from any one of one end portion and the other end portion of the main slot 301 or may be branched from opposite end portions of the main slot 301 as illustrated in FIG. 4.

In addition, the first and second branch slots may be branched from a central portion of the main slot 301 or various positions of the main slot 301, in addition to opposite end portions of the main slot 301 in the horizontal direction.

As described above, paths of the first and second rollers 341 and 342 may be extended or diversified through the first and second branch slots branched from various positions of the main slot 301. Therefore, the moving path of the stapler 100 may also be extended or be diversified.

In addition, as illustrated in FIG. 4, the switching levers 330*a* and 330*b* may be disposed between the first branch slots 310*a* and 310*b* and the second branch slots 320*a* and 320*b*, respectively.

The switching levers 330*a* and 330*b* may selectively open or close the first branch slots 310*a* and 310*b* and the second branch slots 320*a* and 320*b*, respectively, to selectively move the first and second rollers 341 and 342 from the main slot 301 to the first branch slots 310*a* and 310*b* or the second branch slots 320*a* and 320*b*.

The guide part 300 may further include rotation driving units 360*a* and 360*b* each rotating the switching levers 330*a* and 330*b*, and the switching levers 330*a* and 330*b* may rotate in a clockwise direction or a counterclockwise direction through the rotation driving units 360*a* and 360*b*, respectively, to selectively open or close the first branch slots 310*a* and 310*b* and the second branch slots 320*a* and 320*b*, respectively.

A structure of selectively opening or closing the first branch slots 310*a* and 310*b* and the second branch slots 320*a* and 320*b* through the switching levers 330*a* and 330*b* will be described in detail below.

Figure 5A:
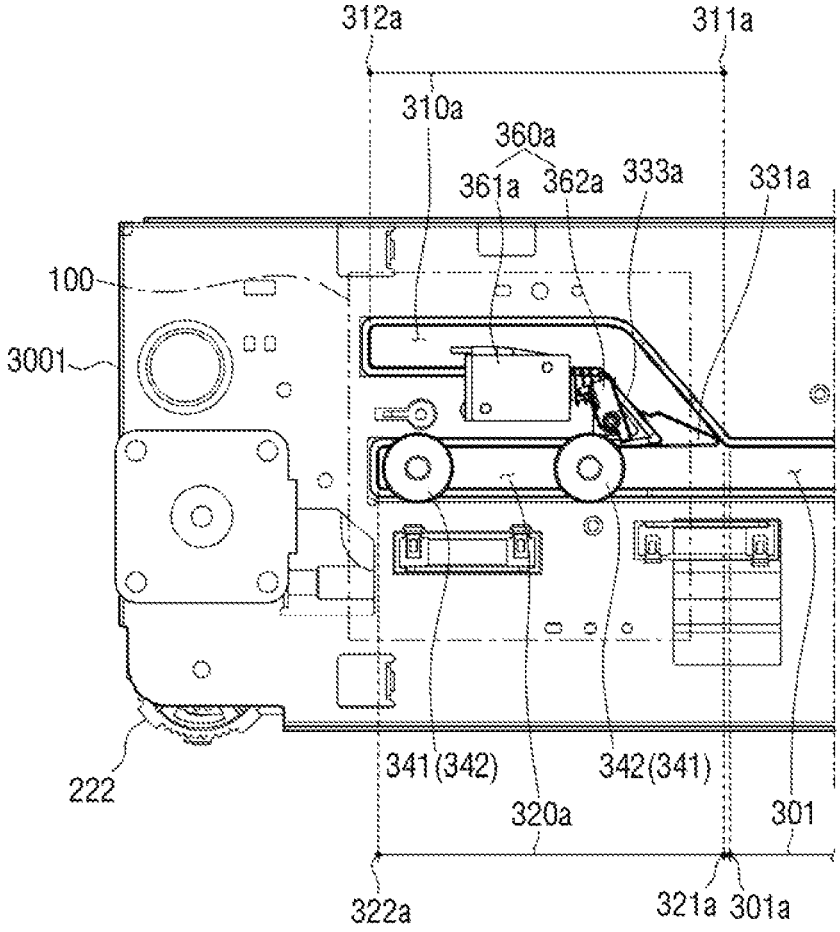
FIGS. 5A and 5B are enlarged views of forms in which first and second rollers illustrated in FIG. 4 move to second branch slots.
Figure 5B:
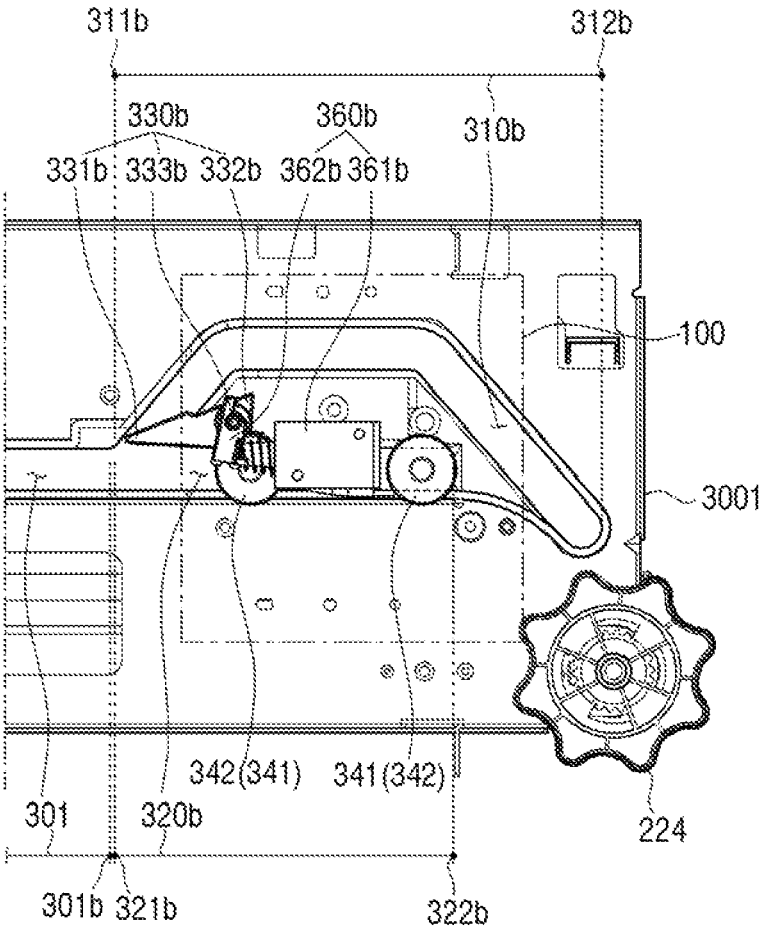

FIGS. 5A and 5B are enlarged views of forms in which first and second rollers 341 and 342 move to second branch slots 320*a* and 320*b*.

FIG. 5A is an enlarged view of first and second branch slots 310*a* and 320*a* branched from one end portion 301*a* of a main slot 301.

As illustrated in FIG. 5A, the switching lever 330*a* may rotate around a shaft 333*a* disposed at the other end portion thereof opposed to one end portion 331*a* thereof so that one end portion 331*a* thereof may selectively open or close the first branch slot 310*a* and the second branch slot 320*a*.

In addition, the rotation driving unit 360*a* may include a solenoid 361*a* and a connection member 362*a*.

One end portion of the connection member 362*a* may be coupled to the shaft 333*a* of the switching lever 330*a*, and the other end portion thereof opposed to one end portion thereof may be coupled to the solenoid 361*a*.

The solenoid 361*a* may push or pull the other end portion of the connection member 362*a* to rotate the switching lever 330*a* around the shaft 333*a*. Therefore, one end portion 331*a* of the switching lever 330*a* may selectively open or close the first branch slot 310*a* or the second branch slot 320*a*.

The solenoid 361*a* may be controlled through the controller to selectively open or close the first branch slot 310*a* and the second branch slot 320*a* through the switching lever 330*a*.

As illustrated in FIG. 5A, the solenoid 361*a* pulls the other end portion of the connection member 362*a*, such that the switching lever 330*a* may rotate in a direction in which it closes the first branch slot 310*a*. Therefore, the second branch slot 320*a* is opened.

In a state in which the second branch slot 320*a* is opened, the first and second rollers 341 and 342 may enter one end portion 321*a* of the second branch slot 320*a* from the main slot 301, and may move in the horizontal direction along the second branch slot 320*a*.

FIG. 5B is an enlarged view of first and second branch slots 310*b* and 320*b* branched from the other end portion 301*b* of a main slot 301.

As illustrated in FIG. 5B, the switching lever 330*b* may rotate around a shaft 333*b* disposed at the other end portion 332*b* thereof opposed to one end portion 331*b* thereof so that one end portion 331*b* thereof may selectively open or close the first branch slot 310*b* and the second branch slot 320*b*. In addition, the rotation driving unit 360*b* may include a solenoid 361*b* and a connection member 362*b*. One end portion of the connection member 362*b* may be coupled to the shaft 333*b* of the switching lever 330*a*, and the other end portion thereof opposed to one end portion thereof may be coupled to the solenoid 361*b*. The solenoid 361*b* may push or pull the other end portion of the connection member 362*b*, such that the switching lever 330*b* may rotate in a direction in which it closes the first branch slot 310*b*. Therefore, the second branch slot 320*b* may be opened, and the first and second rollers 341 and 342 may move in the horizontal direction along the second branch slot 320*b*.

As described above, the switching levers 330*a* and 330*b* each disposed at one end portion 301*a* and the other end portion 301*b* of the main slot 301 close the first branch slots 310*a* and 310*b*, respectively, and open the second branch slots 320*a* and 320*b*, respectively, such that the first and second rollers 341 and 342 may move in the horizontal direction through the second branch slots 320*a* and 320*b* extended from the main slot 301 to the same straight line.

Figure 6A:
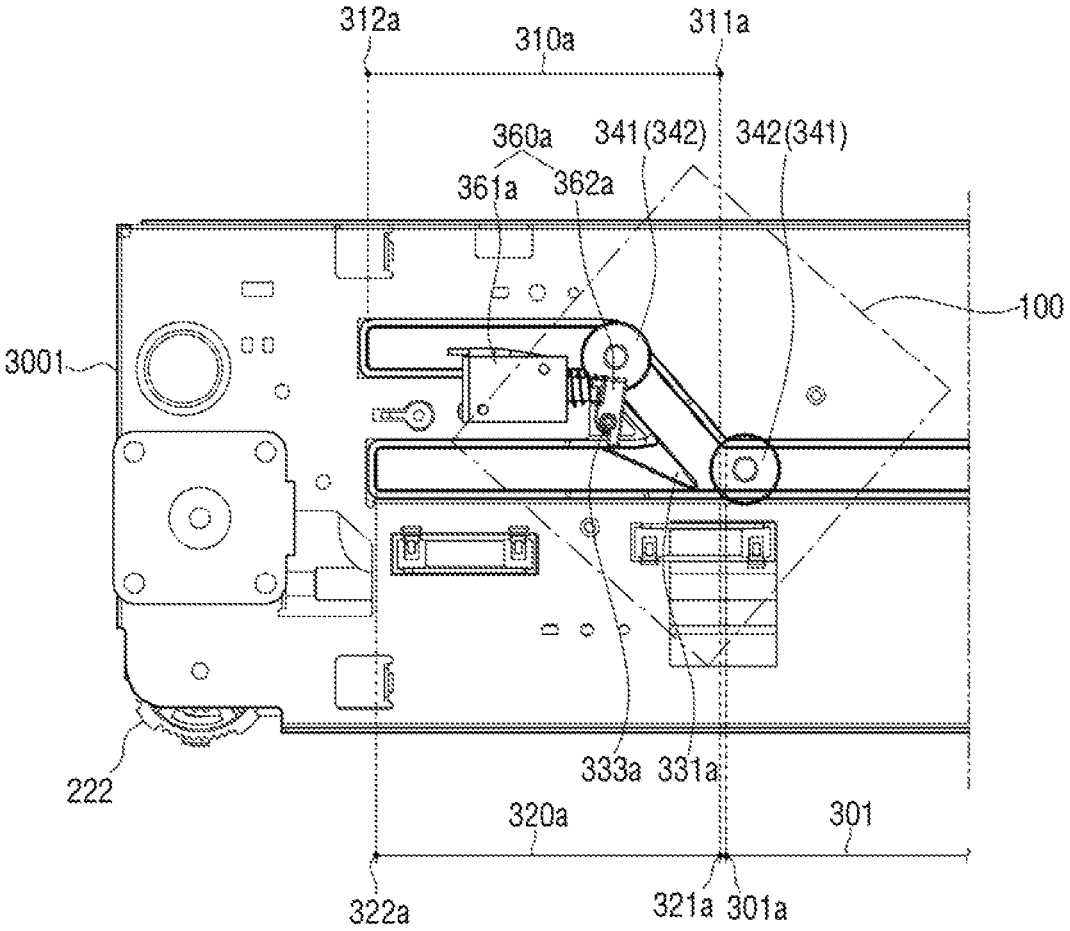
FIGS. 6A and 6B are enlarged views of a form in which the first and second rollers move along a first branch slot branched from one end portion of a main slot.
Figure 6B:
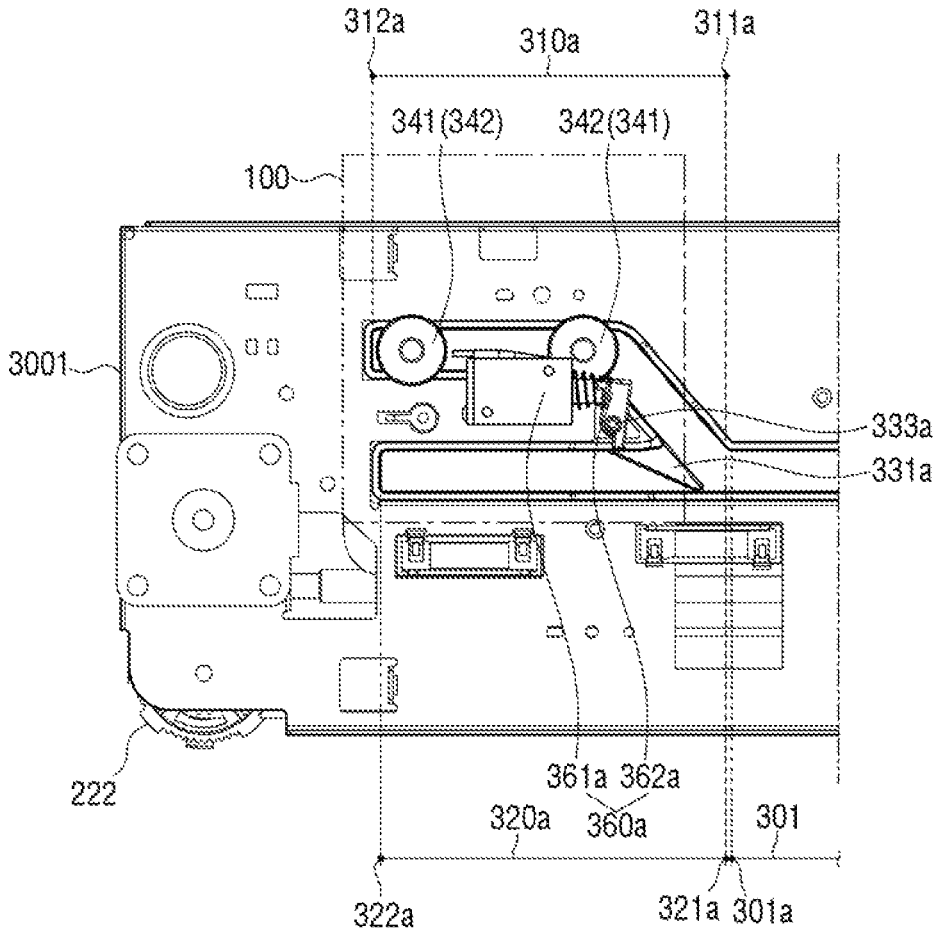

FIGS. 6A and 6B are enlarged views of a form in which the first and second rollers 341 and 342 move along a first branch slot 310*a* branched from one end portion 301*a* of a main slot 301.

As illustrated in FIG. 6A, the solenoid 361*a* pushes the other end portion of the connection member 362*a*, such that the switching lever 330*a* may rotate in the direction in which it closes the second branch slot 320*a*. Therefore, the first branch slot 310*a* is opened.

In a state in which the first branch slot 310*a* is opened, the first and second rollers 341 and 342 may sequentially enter one end portion 311*a* of the first branch slot 310*a*, and may move along the first branch slot 310*a*.

The first and second rollers 341 and 342 are disposed in the inclined section of the first branch slot 310*a*, such that the stapler 100 may rotate. Therefore, the stapler 100 may staple the printing medium in an inclined direction.

In addition, the first and second rollers 341 and 342 may pass through the bent section of the first branch slot 310*a* and then move along a horizontal section parallel with the second branch slot 320*a*, and as illustrated in FIG. 6B, the first and second rollers 341 and 342 may move until the first roller 341 is in contact with the other end portion 312*a* of the first branch slot 310*a*.

Figure 7A:
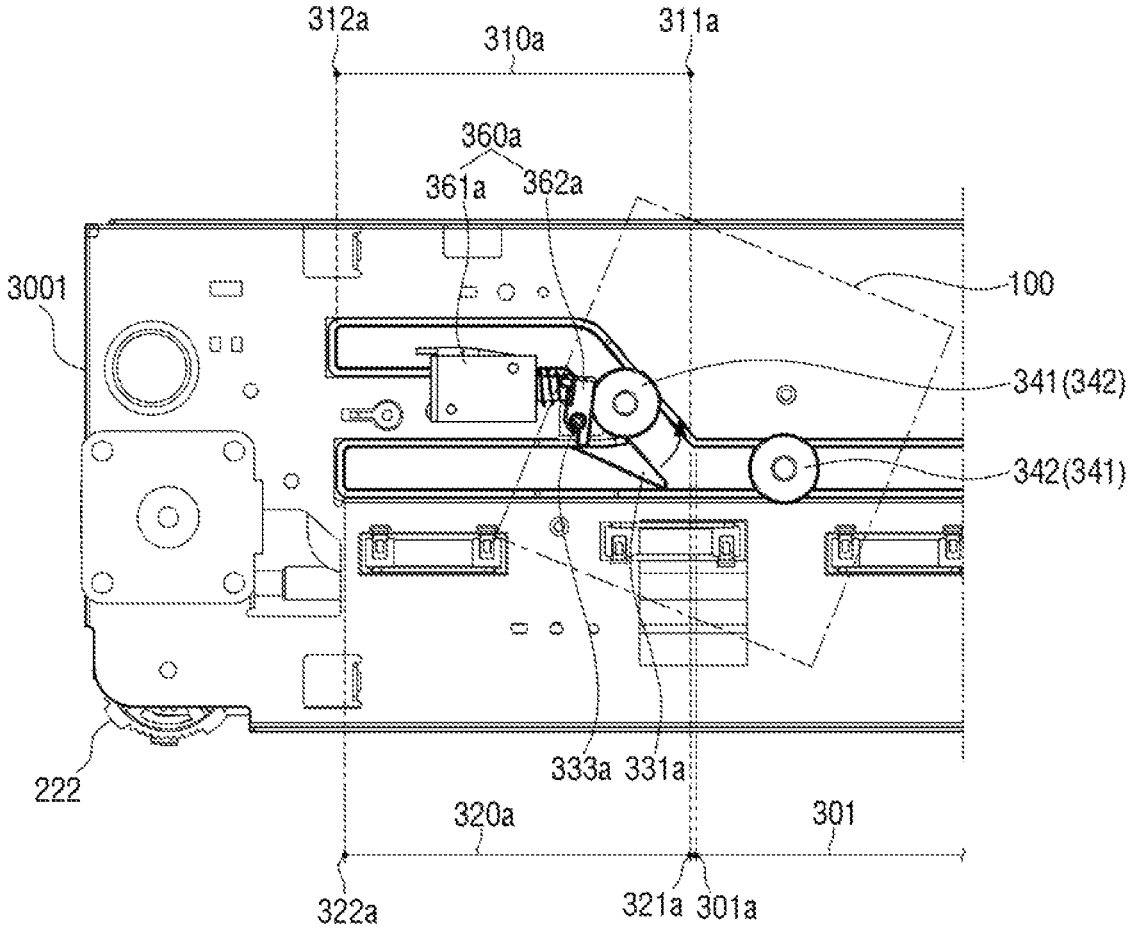
FIGS. 7A to 7C are enlarged views of a form in which the first and second rollers move, respectively, along the first and second branch slots branched from one end portion of the main slot.
Figure 7B:
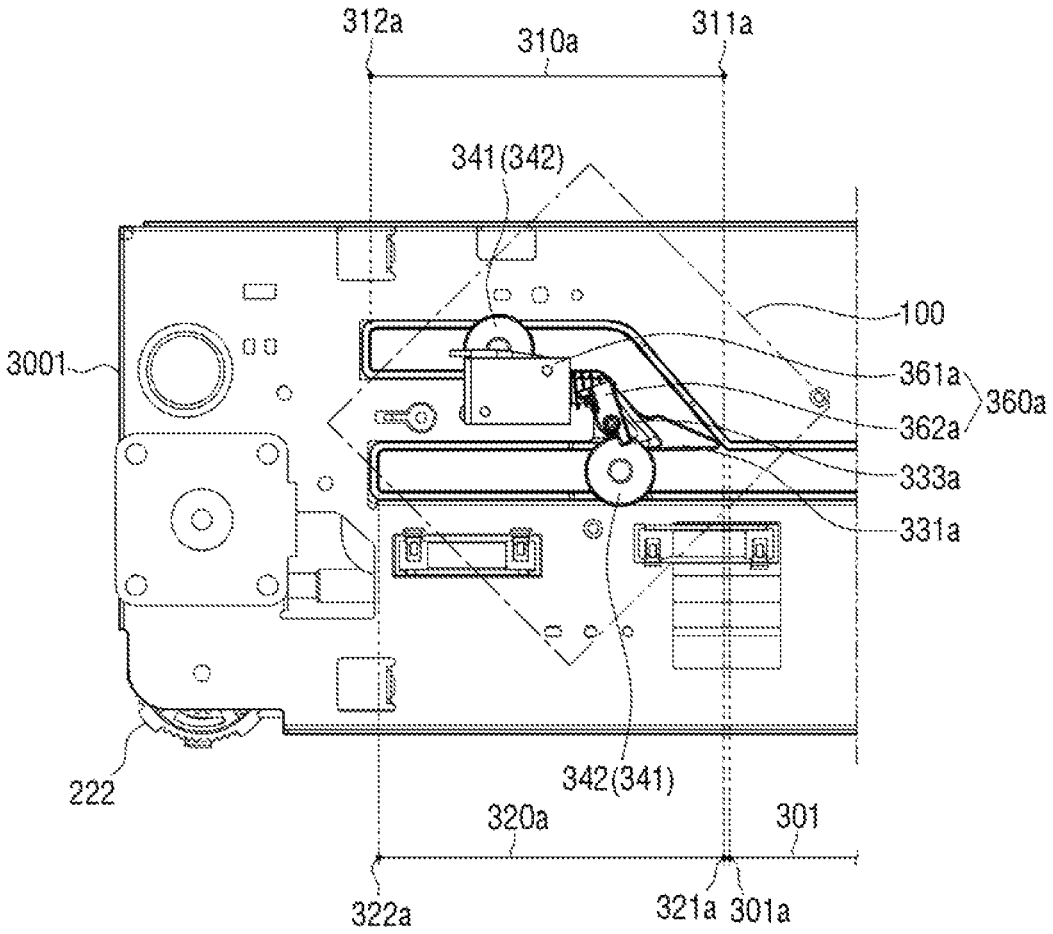
Figure 7C:
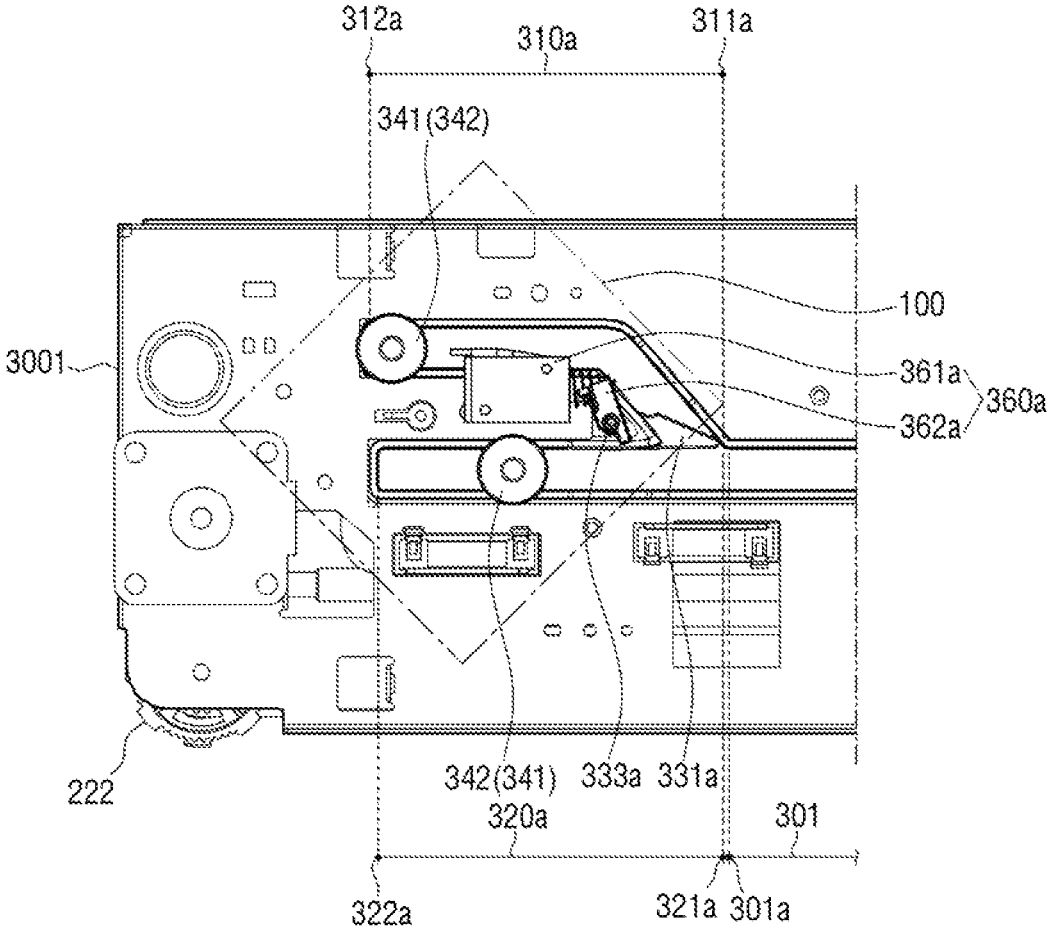

FIGS. 7A to 7C are views illustrating a form in which the first roller 341 moves along the first branch slot 310*a* branched from one end portion 301*a* of the main slot 301 and the second roller 342 moves along the second branch slot 320*a* branched from one end portion 301*a* of the main slot 301.

As illustrated in FIG. 7A, when the first roller 341 enters the first branch slot 310*a* through one end portion 311*a* of the first branch slot 310*a* in a state in which the switching lever 330*a* closes the second branch slot 320*a*, the solenoid 361*a* pulls the other end portion of the connection member 362*a*, such that the switching lever 330*a* may rotate in a direction in which it closes the first branch slot 310*a*.

When the switching lever 330*a* rotates to close the first branch slot 310*a* and open the second branch slot 320*a*, the second roller 342 following the first roller 341 may enter one end portion 321*a* of the second branch slot 320*a*, as illustrated in FIG. 7B.

As described above, immediately after the first roller 341 enters the first branch slot 310*a*, the switching lever 330*a* rotates to close the first branch slot 310*a* and open the second branch slot 320*a*, such that the first and second rollers 341 and 342 may enter the first and second branch slots 310*a* and 320*a*, respectively.

Therefore, as illustrated in FIGS. 7B and 7C, the first roller 341 moves along the first branch slot 310*a*, and the second roller 342 moves along the second branch slot 320*a*, such that the stapler 100 may move in an inclined state in the horizontal direction.

Figure 8A:
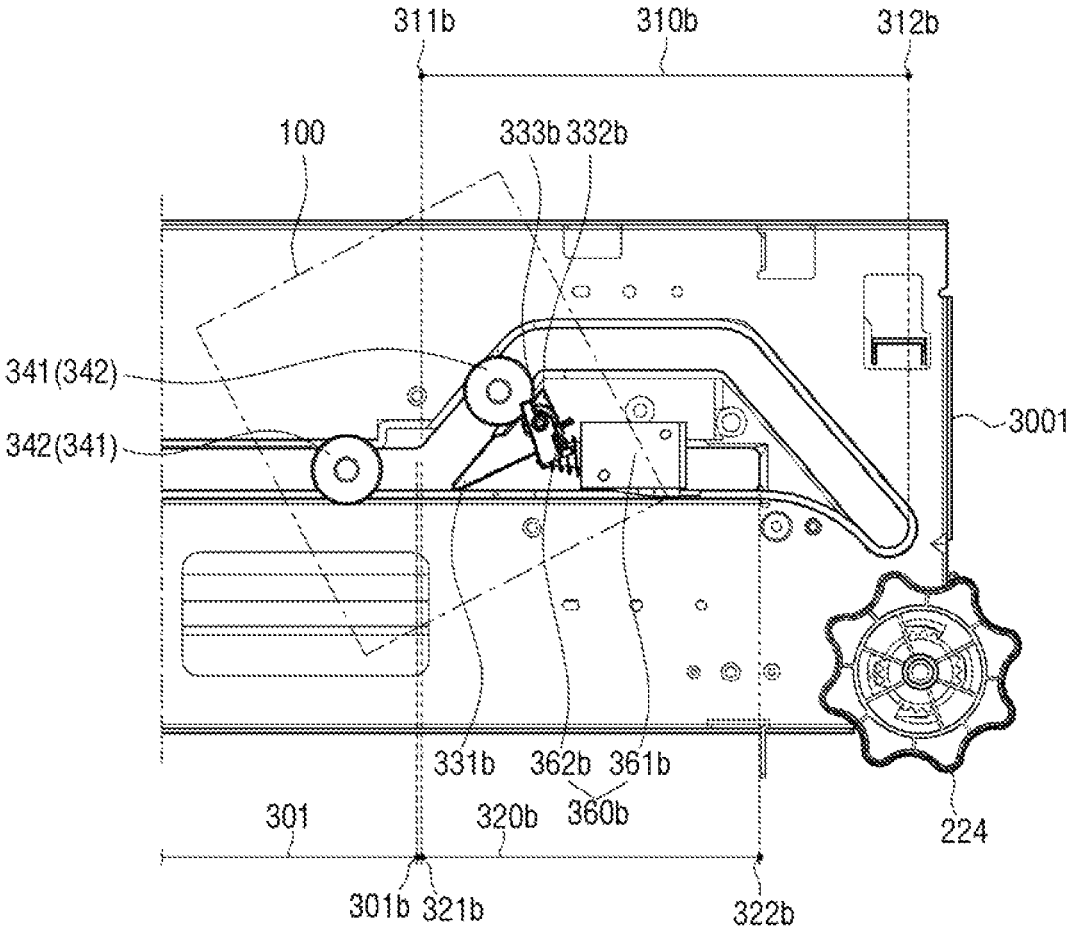
FIGS. 8A to 8C are enlarged views of a form in which the first and second rollers move along the first branch slot branched from the other end portion of the main slot.
Figure 8B:
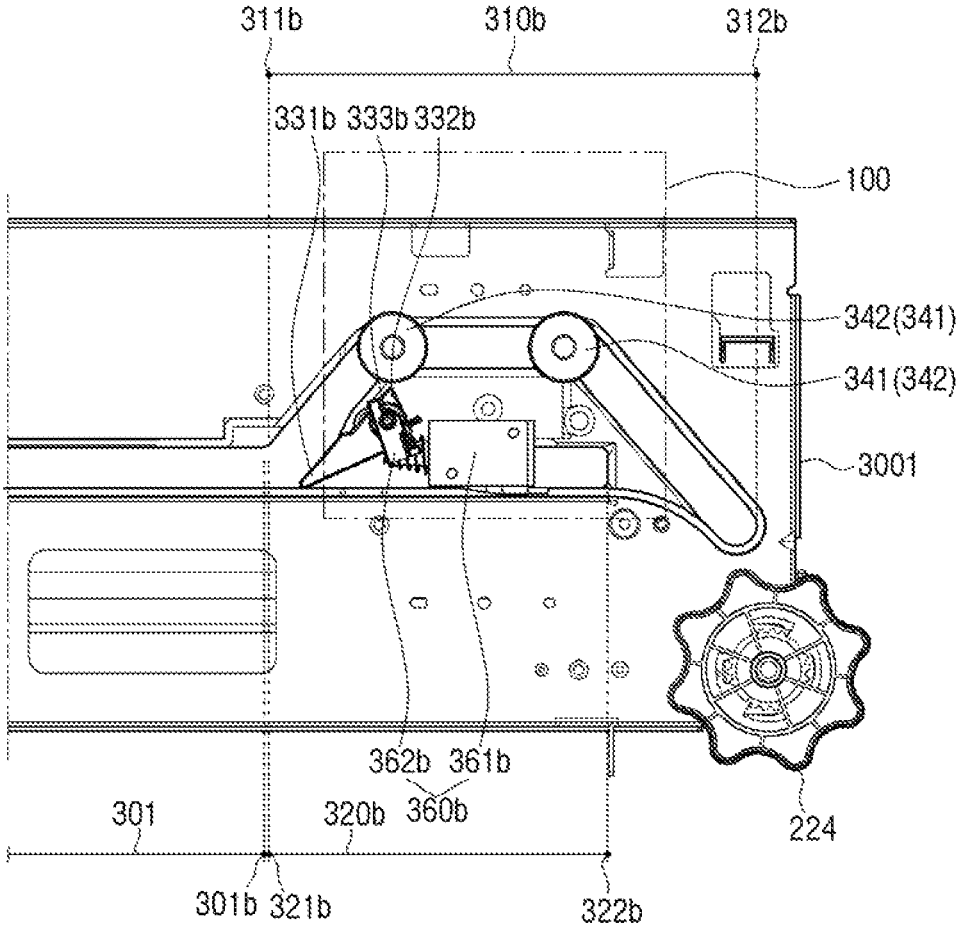
Figure 8C:
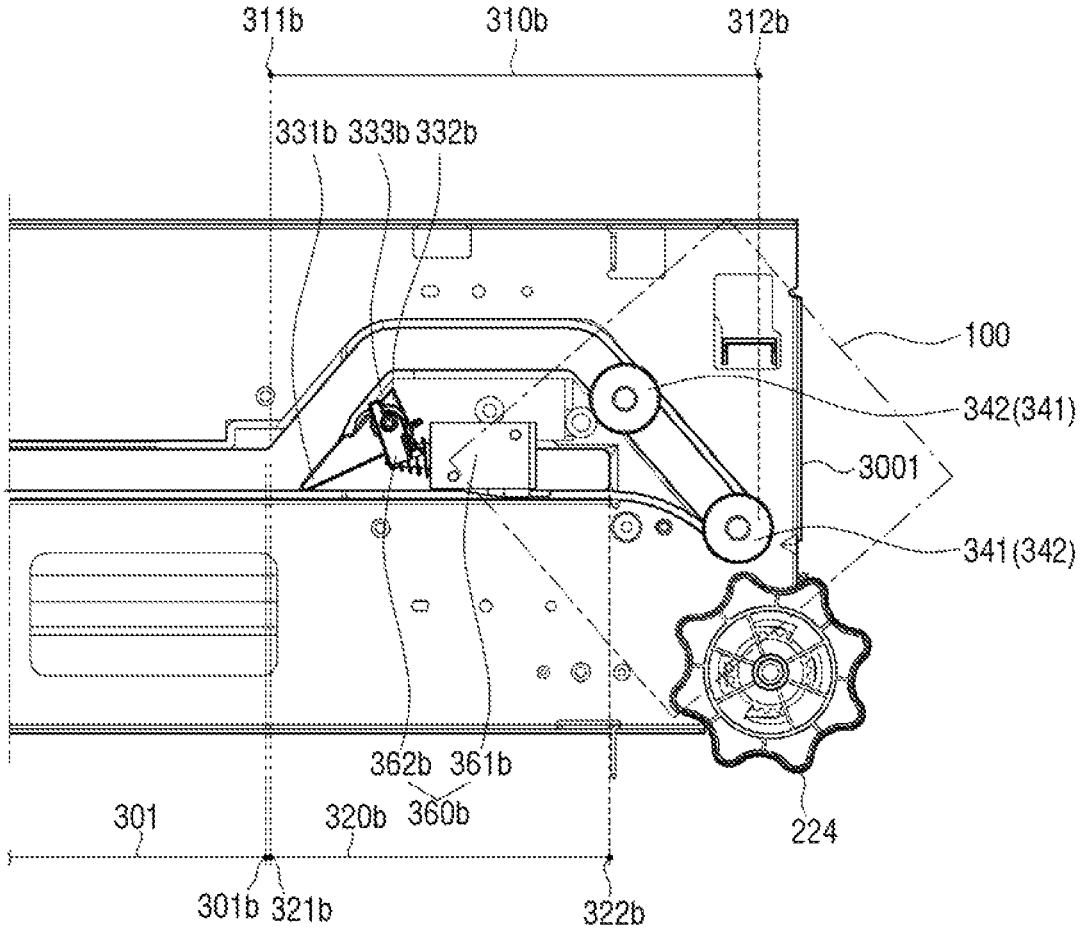

FIGS. 8A to 8C are enlarged views of a form in which the first and second rollers 341 and 342 move along the first branch slot 310*b* branched from the other end portion 301*b* of the main slot 301.

As illustrated in FIG. 8A, in a state in which the first branch slot 310*b* is opened, the first and second rollers 341 and 342 may sequentially enter one end portion 311*b* of the first branch slot 310*b*, and may move along the first branch slot 310*b*.

As illustrated in FIG. 8A, the first and second rollers 341 and 342 enter the inclined section of the first branch slot 310*b*, such that the stapler 100 may rotate.

In addition, as illustrated in FIG. 8B, the first and second rollers 341 and 342 may pass through the inclined section and the bent section and then move along a section parallel with the second branch slot 320*b*.

In addition, as illustrated in FIG. 8C, the first and second rollers 341 and 342 may additionally pass through the bent section and then move up to the other end portion 312*b* of the first branch slot 310*b*. Therefore, the stapler 100 may rotate in various directions and at various angles.

In addition, a path of the first branch slot 310*b* may be modified into various paths, in addition to the path illustrated in FIGS. 8A to 8C. Therefore, a moving path and an angle of the stapler 100 may also be variously modified.

Figure 9A:
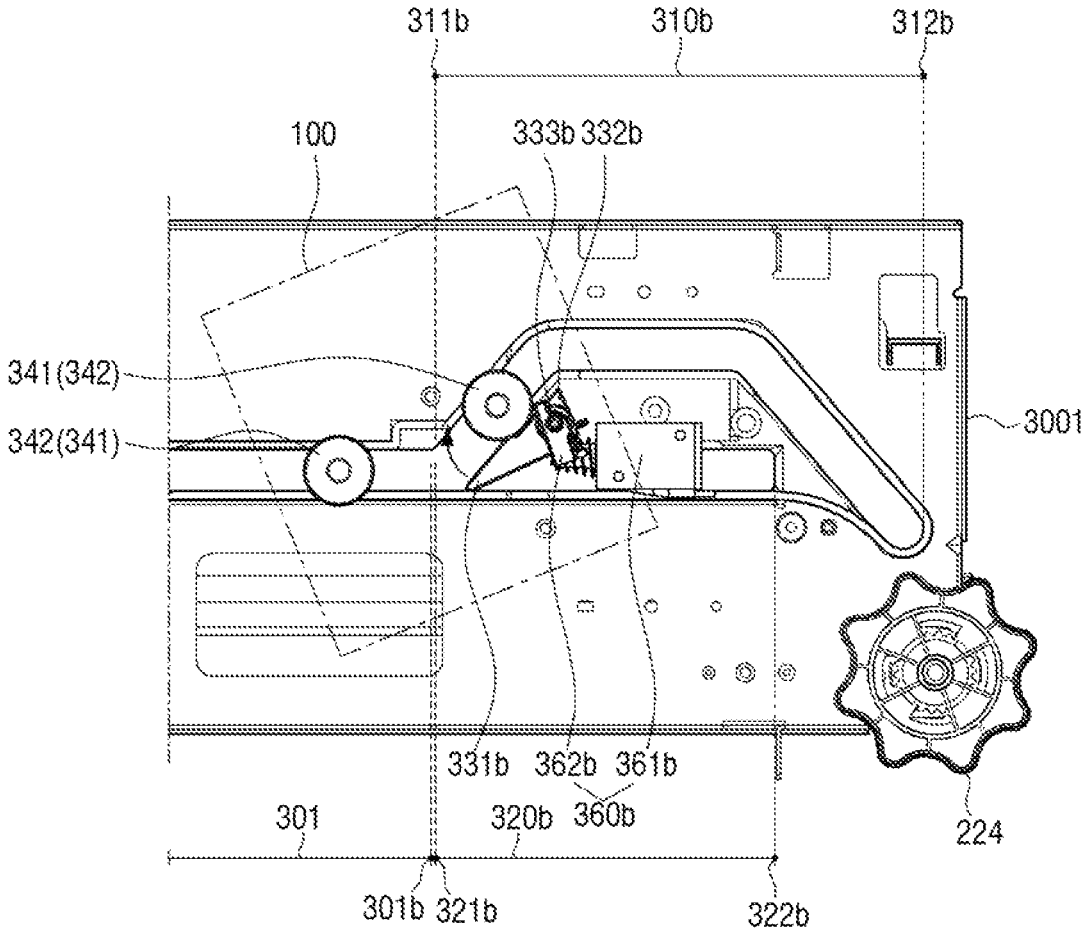
FIGS. 9A to 9C are enlarged views of a form in which the first and second rollers move, respectively, along the first and second branch slots branched from the other end portion of the main slot.
Figure 9B:
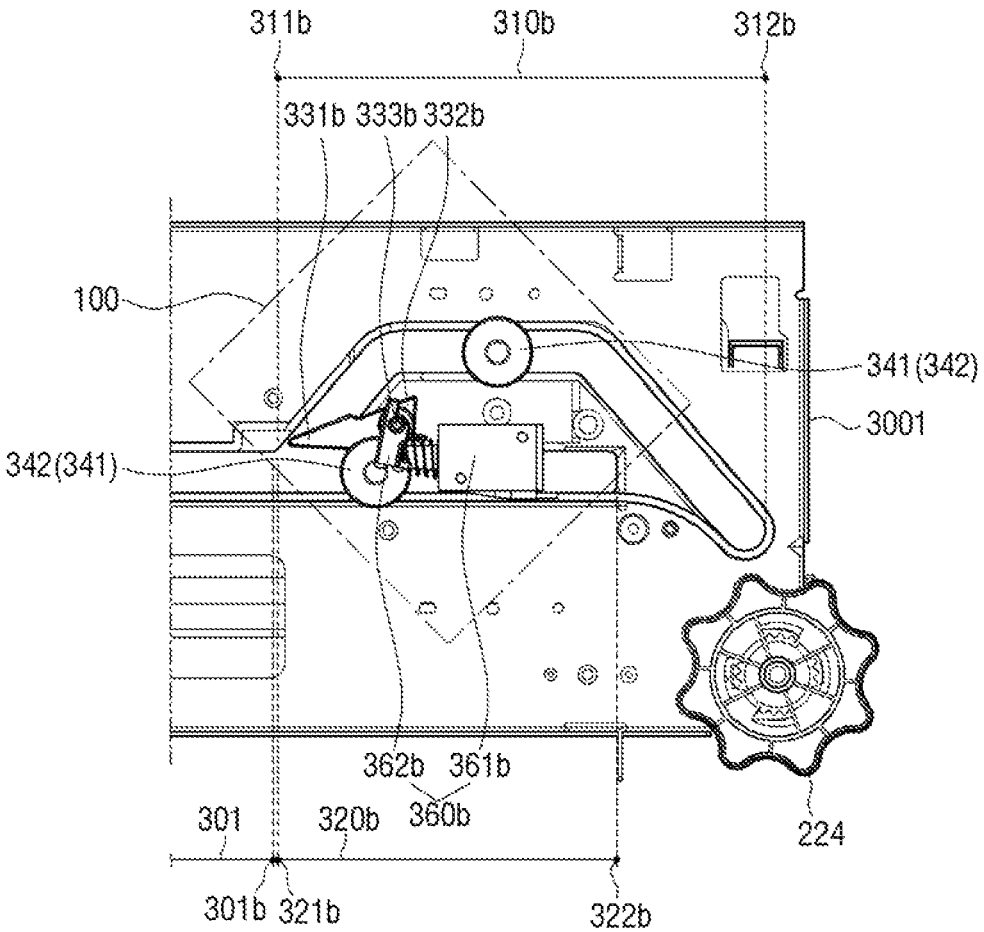
Figure 9C:
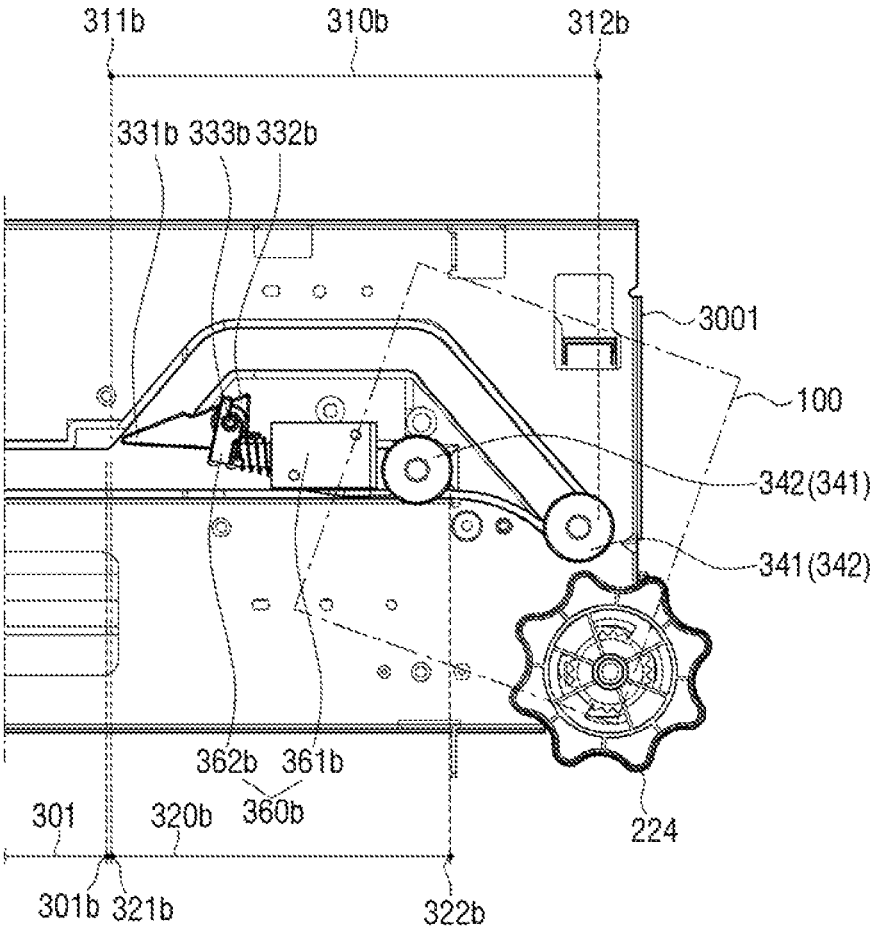

FIGS. 9A to 9C are views illustrating a form in which the first roller 341 moves along the first branch slot 310*b* branched from the other end portion 301*b* of the main slot 301 and the second roller 342 moves along the second branch slot 320*b* branched from the other end portion 301*b* of the main slot 301.

As illustrated in FIG. 9A, when the first roller 341 enters the first branch slot 310*b* through one end portion 311*b* of the first branch slot 310*b* in a state in which the switching lever 330*b* closes the second branch slot 320*b*, the solenoid 361*b* pushes the other end portion of the connection member 362*b*, such that the switching lever 330*b* may rotate in a direction in which it closes the first branch slot 310*b*.

Therefore, as illustrated in FIG. 9B, the second roller 342 following the first roller 341 may enter one end portion 321*b* of the second branch slot 320*a*.

As described above, immediately after the first roller 341 enters the first branch slot 310*b*, the switching lever 330*b* rotates to close the first branch slot 310*b* and open the second branch slot 320*b*, such that the first and second rollers 341 and 342 may enter the first and second branch slots 310*b* and 320*b*, respectively.

As described above, the first branch slot 310*b* may include the plurality of bent sections, such that a path of the first branch slot 310*b* may be variously bent. Therefore, as illustrated in FIGS. 9B and 9C, the first roller 341 moves along the first branch slot 310*b*, and the second roller 342 moves along the second branch slot 320*b*, such that the stapler 100 may move while being deformed at various angles in an inclined state.

Figure 10:
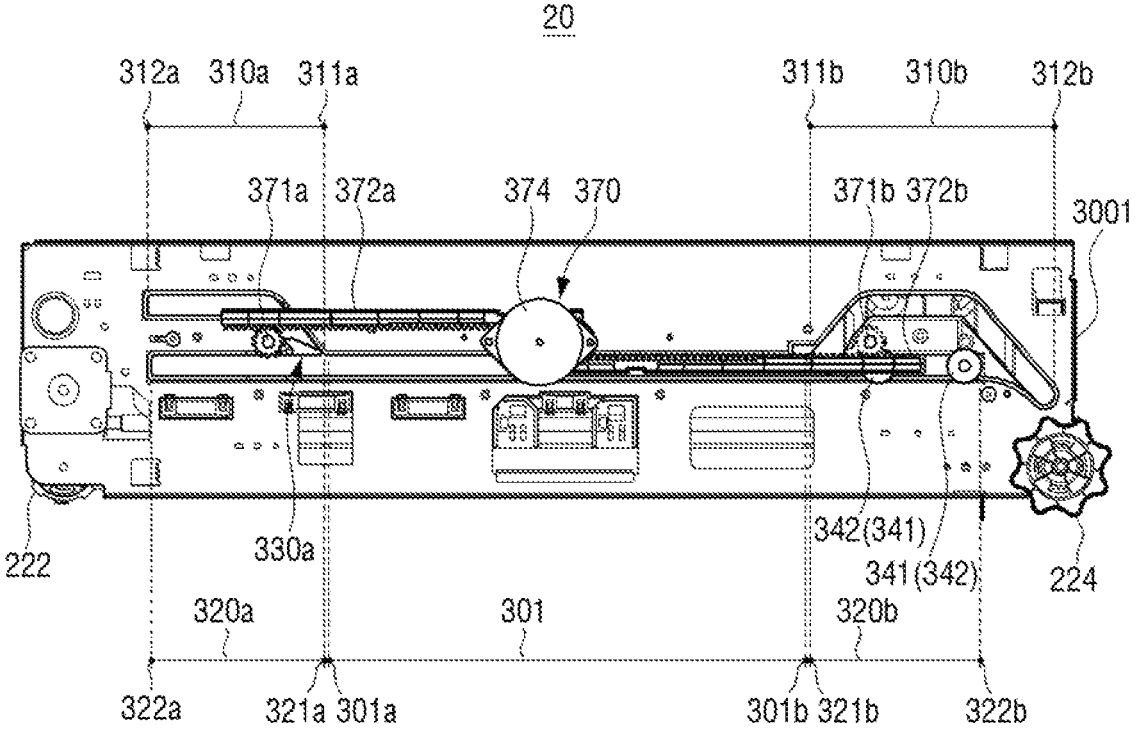
FIG. 10 is a bottom view of a stapling apparatus according to another example.
Figure 11:
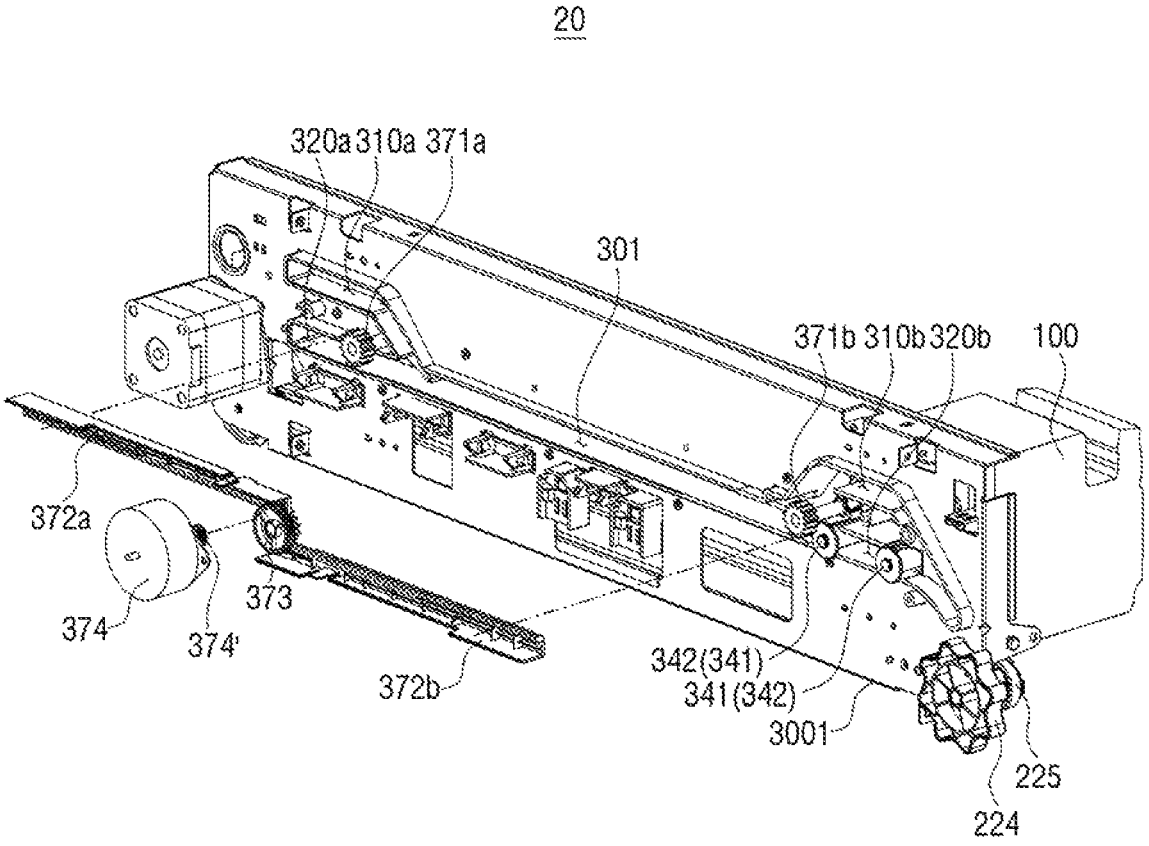
FIG. 11 is an exploded perspective view of a rotation driving unit of the stapling apparatus illustrated in FIG. 10.

FIG. 10 is a bottom view of a stapling apparatus 20 according to another example, and FIG. 11 is an exploded perspective view of a rotation driving unit 370 of the stapling apparatus 20 illustrated in FIG. 10.

The stapling apparatus 20 illustrated in FIGS. 10 and 11 may include a stapler 100, a driver 200, and a guide part 300.

Components of the stapling apparatus 20 according to another example except for a rotation driving unit 370 are the same as those of the stapling apparatus 10 according to an example.

Therefore, in describing a structure of the stapling apparatus 20 according to another example, a description overlapped with that for the stapling apparatus 10 according to an example will be omitted, and a structure of the rotation driving unit 370 will be mainly described hereinafter.

A guide plate 3001 may further include first branch slots 310*a* and 310*b* and second branch slots 320*a* and 320*b* branched from one end portion 301*a* and the other end portion 301*b* of a main slot 301.

In addition, switching levers 330*a* and 330*b* selectively opening or closing the first branch slots 310*a* and 310*b* and the second branch slots 320*a* and 320*b*, respectively, may be disposed between the first branch slots 310*a* and 310*b* and the second branch slots 320*a* and 320*b*, respectively.

Hereinafter, for convenience of explanation, the first branch slot 310*b* branched from the other end portion 301*b* of the main slot 301 will be referred to as a third branch slot 310*b*, and the second branch slot 320*b* branched from the other end portion 301*b* of the main slot 301 will be referred to as a fourth branch slot 320*b*.

In addition, the switching lever 330*a* disposed between the first branch slot 310*a* and the second branch slot 320*a* branched from one end portion 301*a* of the main slot 301 will be referred to as a first switching lever 330*a*, and the switching lever 330*b* disposed between the third branch slot 310*b* and the fourth branch slot 320*b* will be referred to as a second switching lever 330*b*.

The rotation driving unit 370 according to another example may simultaneously rotate the first and second switching levers 330*a* and 330*b* through one motor 374.

In detail, the rotation driving unit 370 may include a first pinion gear 371*a* coupled to a shaft 333*a* of the first switching lever 330*a*, a first rack gear 372*a* having one end portion engaged with the first pinion gear 371*a*, a second pinion gear 371*b* coupled to the shaft 333*b* of the second switching lever 330*b*, a second rack gear 372*b* having one end portion engaged with the second pinion gear 371*b*, a driving pinion gear 373 simultaneously engaged with the other end portion of the first rack gear 372*a* and the other end portion of the second rack gear 372*b*, and a motor 374, and the motor 374 may further include a driving gear 374' engaged with the driving pinion gear 373.

The driving gear 374' coupled to the motor 374 rotates, such that the driving pinion gear 373 may rotate, and the first and second rack gears 372*a* and 372*b* may simultaneously rotate the first and second pinion gears 371*a* and 371*b*, respectively, while simultaneously moving by the rotation of the driving pinion gear 373.

Therefore, the first and second pinion gears 371*a* and 371*b* simultaneously rotate, such that the first and second switching levers 330*a* and 330*b* may simultaneously rotate.

As described above, since the rotation driving unit 370 of the stapling apparatus 20 according to another example may simultaneously rotate a plurality of switching levers 330*a* and 330*b* through one motor 374, a structure of the stapling apparatus 20 may be further simplified.

In addition, even though a switching lever is additionally disposed in addition to the first and second switching levers 330*a* and 330*b*, a pinion gear engaged with the first and second rack gears 372*a* and 372*b* is added, and is coupled to a shaft of the additionally disposed switching lever, such that a plurality of branch slots may be selectively opened or closed by a single motor also in a stapling apparatus including a plurality of switching levers.

Figure 12:
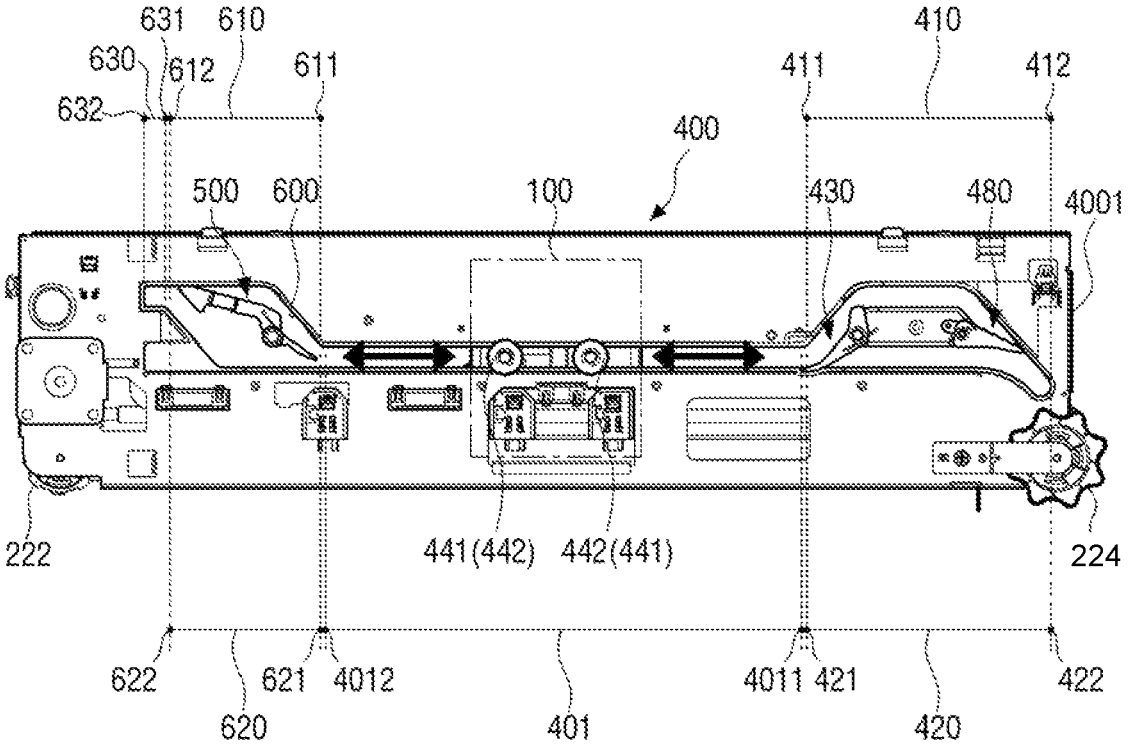
FIG. 12 is a bottom view of a stapling apparatus according to another example of the disclosure.

FIG. 12 is a bottom view of a stapling apparatus 30 according to another example of the disclosure.

The stapling apparatus 30 according to another example of the disclosure may include a stapler 100, a driver 200, and a guide part 400.

*174 Since the stapler 100 and the driver 200 are the same as those of the stapling apparatus 10 illustrated in FIG. 4, an overlapped description will be omitted.

The guide part 400 may include a guide plate 4001, and a slot guiding movement of the stapler 100 is formed in the guide plate 4001.

As illustrated in FIG. 12, a main slot 401 extended in a horizontal direction may be disposed at the center of the guide plate 4001, and first and second branch slots 410 and 420 branched from the main slot 401 may be formed at one end portion 4011 of the main slot 401.

The first and second branch slots 410 and 420 may be branched from one end portion 4011 of the main slot 401 at various angles and in various directions.

For example, as illustrated in FIG. 12, the first branch slot 410 may be branched in an inclined form from one end portion 4011 of the main slot 401, and the second branch slot 420 may be formed on the same straight line as that of the main slot 401 to extend the main slot 401 in the horizontal direction.

A first switching lever 430 may be disposed between the first branch slot 410 and the second branch slot 420, and may selectively open or close the first branch slot 410 and the second branch slot 420.

In addition, the first switching lever 430 may further include a first elastic member 434 (see FIG. 13*a*) applying force to the first switching lever 430 so that the first switching lever 430 rotates in a first direction in which it closes the second branch slot 420.

Therefore, as illustrated in FIG. 12, the first switching lever 430 may maintain a state in which it closes the second branch slot 420 by the first elastic member 434.

In addition, the other end portion 412 of the first branch slot 410 and the other end portion 422 of the second branch slot 420 may be connected to each other so that the first branch slot 410 and the second branch slot 420 form a closed loop.

In addition, a blocking lever 480 opening or closing the other end portion 412 of the first branch slot 410 may be further included between the other end portion 412 of the first branch slot 410 and the other end portion 422 of the second branch slot 420. The blocking lever 480 may block a first roller 441 from entering the first branch slot 410 from the second branch slot 420. A configuration of the blocking lever 480 will be described below.

FIGS. 13A to 13D are enlarged views of a form in which first and second rollers 441 and 442 move along first and second branch slots 410 and 420.

Figure 13A:
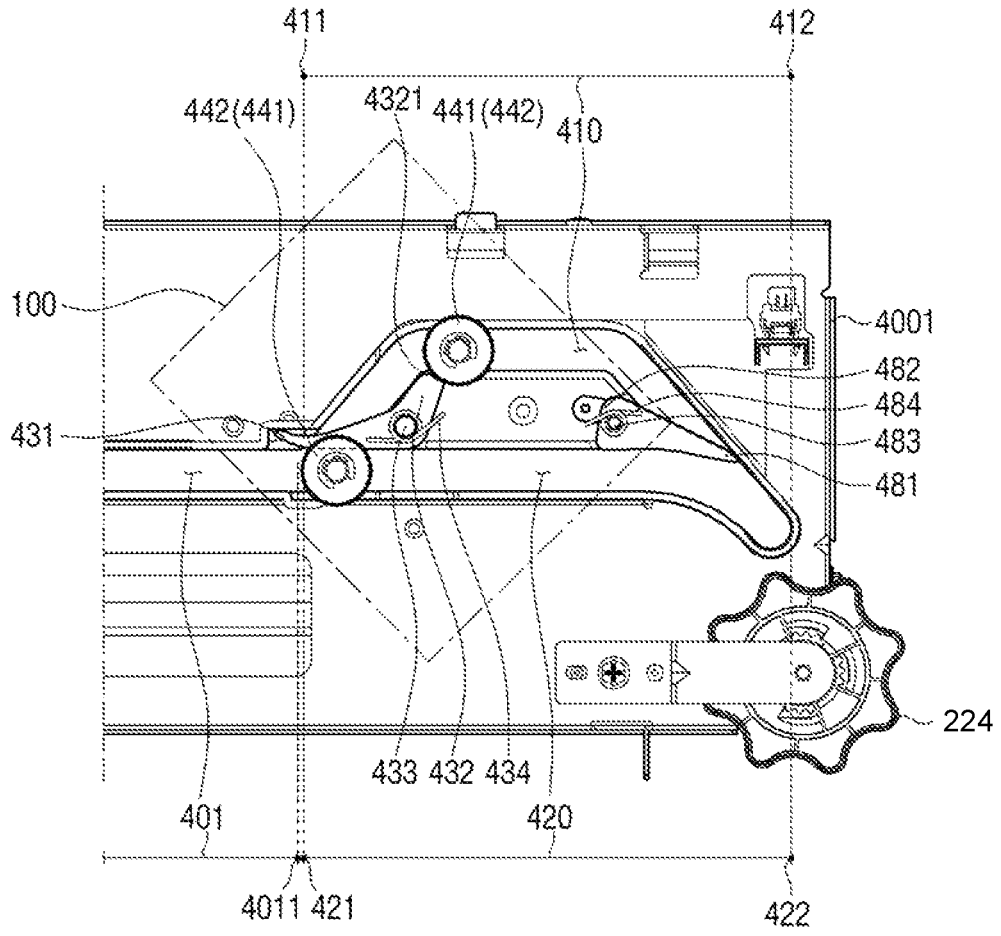
FIGS. 13A to 13D are enlarged views of a form in which first and second rollers illustrated in FIG. 12 move along first and second branch slots.

Referring to FIG. 13A, the first switching lever 430 may rotate around a shaft 433 disposed at the other end portion 432 thereof opposed to one end portion 431 thereof so that one end portion 431 thereof may selectively open or close the first branch slot 410 and the second branch slot 420.

In addition, the first elastic member 434 may be coupled to the shaft 433 of the first switching lever 430 to apply the force to the first switching lever 430 so that the first switching lever 430 rotates in the first direction in which it closes the second branch slot 420.

The first switching lever 430 may further include a protrusion part 4321 protruding from the other end portion 432 of the first switching lever 430 toward an inner side of the first branch slot 410.

The protrusion part 4321 may be subjected to interference by the first roller 441 passing through the first branch slot 410, and may be pressed by the first roller 441.

In detail, the first switching lever 430 may receive the force applied from the first elastic member 434 to maintain a state in which the first branch slot 410 is opened, and the first roller 441 may enter one end portion 411 of the first branch slot 410.

The first roller 441 moving along the first branch slot 410 passes through the first branch slot 410 while pressing the protrusion part 4321 of the first switching lever 430, and the first roller 441 presses the protrusion part 4321, such that the first switching lever 430 may rotate in a second direction in which it closes the first branch slot 410.

For example, it may be that force at which the first roller 441 presses the protrusion part 4321 is greater than force at which the first elastic member 434 rotates the first switching lever 430 in the first direction in which the first switching lever 430 closes the second branch slot 420.

As illustrated in FIG. 13A, when the first switching lever 430 rotates in the second direction by the first roller 441 pressing the protrusion part 4321, the second roller 442 following the first roller 441 may enter one end portion 421 of the opened second branch slot 420.

As described above, as the first roller 441 presses the protrusion part 4321 while moving along the first branch slot 410, the first switching lever 430 rotates in the second direction in which it opens the second branch slot 420, such that the first and second rollers 441 and 442 may enter the first and second branch slots 410 and 420, respectively.

Figure 13B:
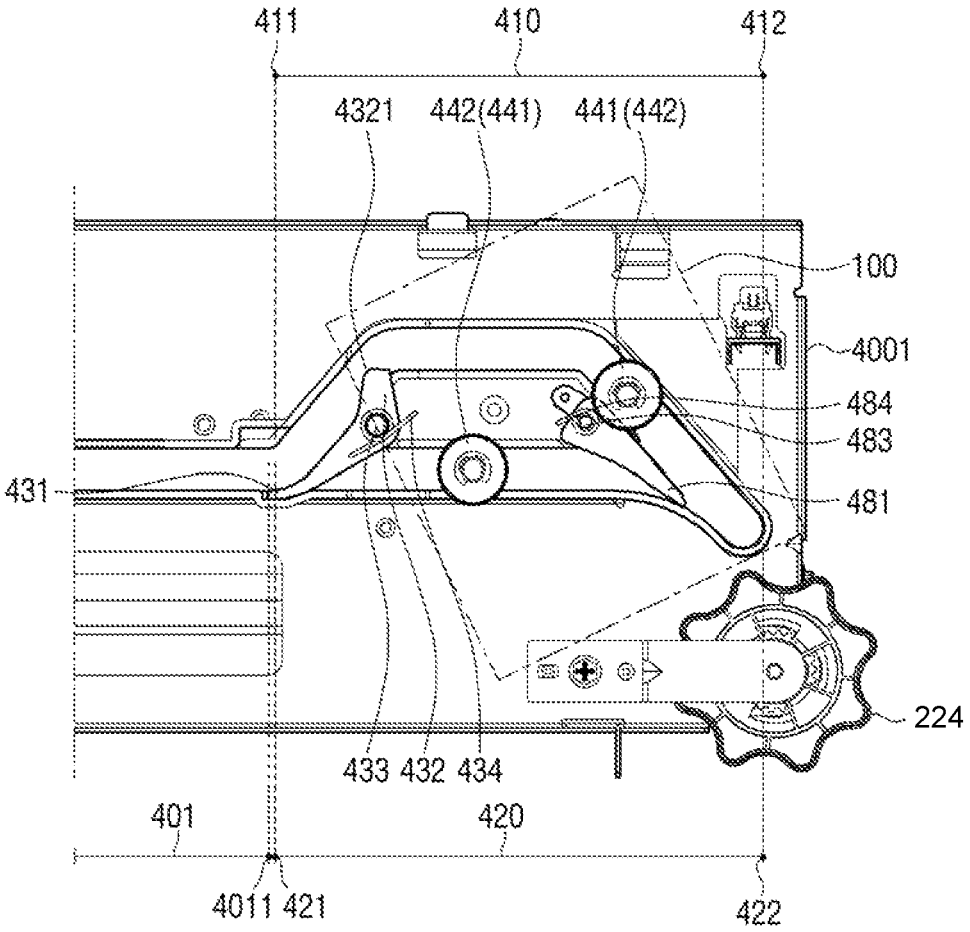

Referring to FIG. 13B, as described above, since the first roller 441 passes through the first branch slot 410 while pressing the protrusion part 4321, as soon as the protrusion part 4321 is released from being pressed from the first roller 441, the first switching lever 430 again rotates in the first direction in which it closes the second branch slot 420 due to the first elastic member 434.

Again referring to FIG. 13A, the blocking lever 480 may rotate around a shaft 483 disposed at the other end portion 482 thereof so that one end portion 481 thereof opens or closes the other end portion 412 of the first branch slot 410.

In addition, a blocking elastic member 484 may be coupled to the shaft 483 of the blocking lever 480 to apply force the blocking lever 480 so that the blocking lever 480 rotates in a third direction in which the blocking lever 480 closes the other end portion 412 of the first branch slot 410.

Therefore, the blocking lever 480 may maintain a state in which it closes the other end portion 412 of the first branch slot 410 due to the blocking elastic member 484, as illustrated in FIG. 13A.

In addition, the blocking lever 480 may be supported by an inner sidewall of the first branch slot 410 in a state in which one end portion 481 thereof closes the other end portion 412 of the first branch slot 410.

As illustrated in FIG. 13B, the first roller 441 moving along the first branch slot 410 may press one end portion 481 of the blocking lever 480.

As described above, one end portion 481 of the blocking lever 480 is pressed by the first roller 441, such that the blocking lever 480 may rotate in a fourth direction in which it opens the other end portion 412 of the first branch slot 410 and the first roller 441 may pass through the opened other end portion 412 of the first branch slot 410 and then enter the other end portion 422 of the second branch slot 420.

Figure 13C:
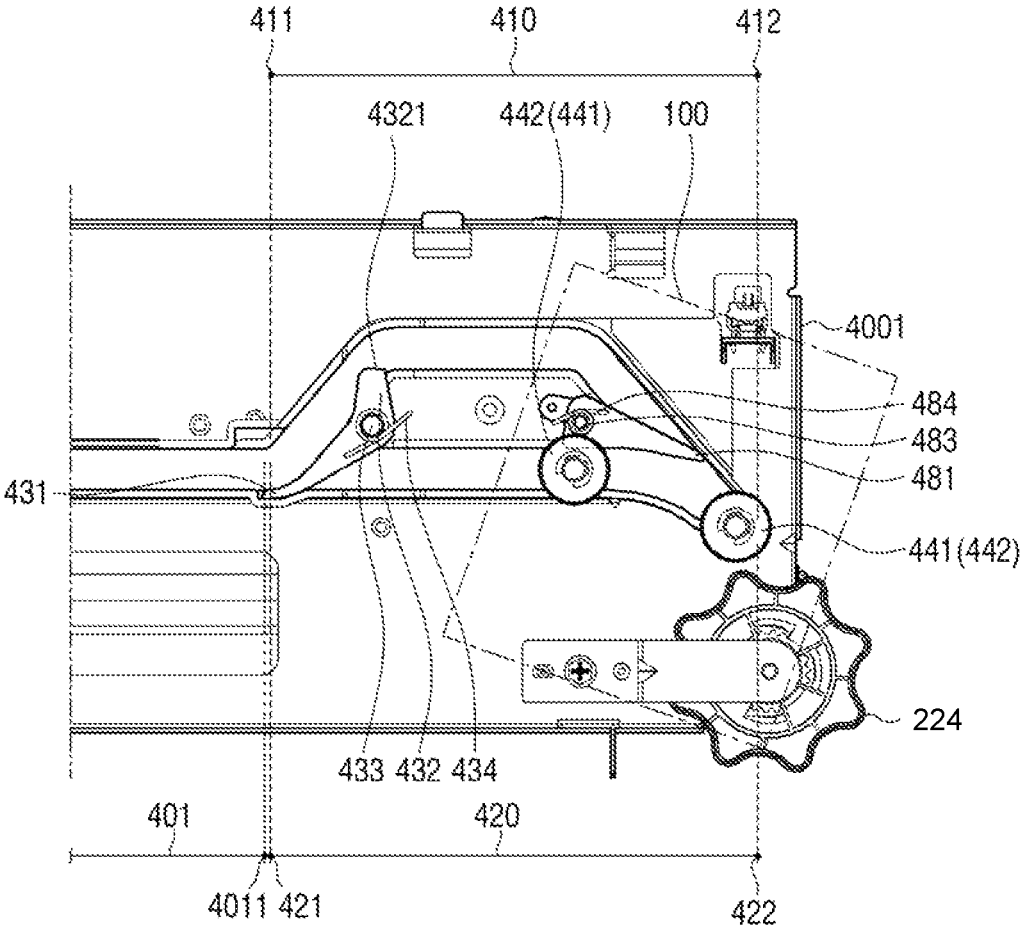

Referring to FIG. 13C, since the first roller 441 passes through the other end portion 412 of the first branch slot 410 while pressing the blocking lever 480, as soon as the blocking lever 480 is released from being pressed from the first roller 441, the blocking lever 480 again rotates in the third direction in which it closes the other end portion 412 of the first branch slot 410 due to the blocking elastic member 484.

The first roller 441 entering the other end portion 422 of the second branch slot 420 may move together with the second roller 442 along the second branch slot 420. In this case, the first roller 441 follows the second roller 442.

Figure 13D:
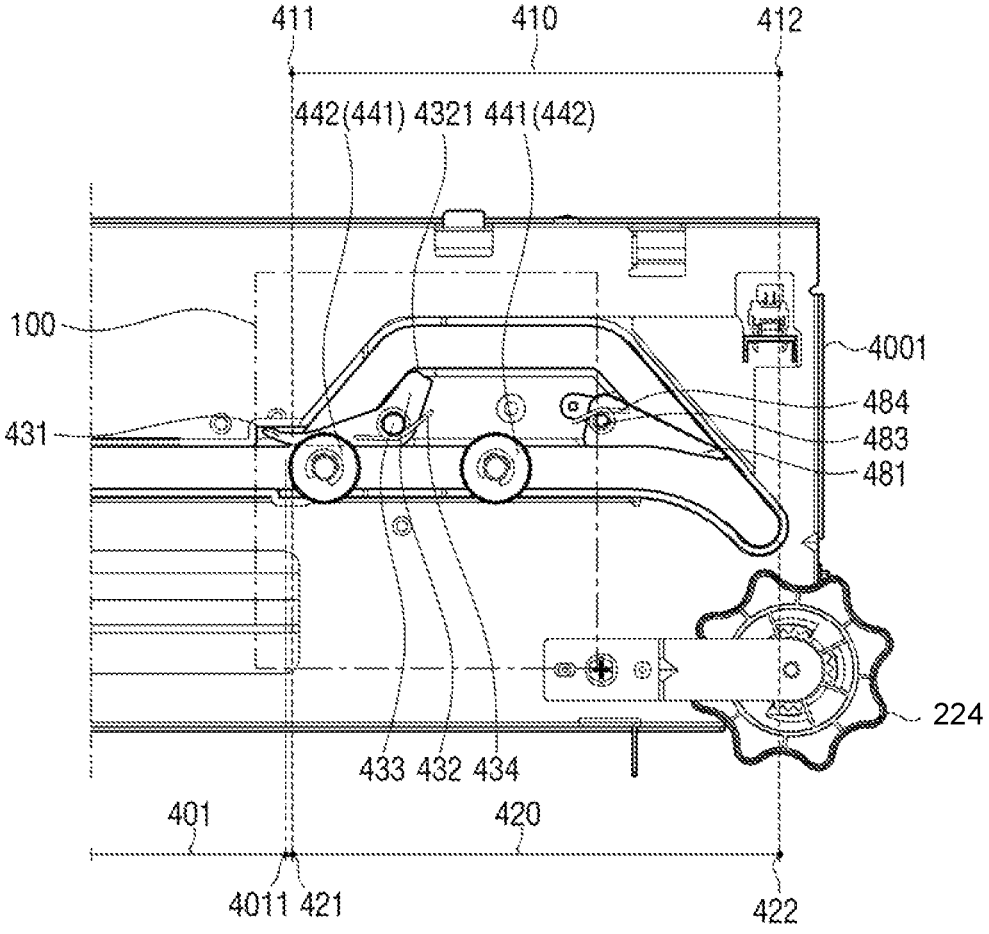

In the first and second roller 441 and 442 moving toward the main slot 401 along the second branch slot 420, as illustrated in FIG. 13D, the second roller 442 may press one end portion 431 of the first switching lever 430 to open one end portion 421 of the second branch slot 420, enter the main slot 401 through one end portion 4011 of the main slot 401, and move along the main slot 401.

Therefore, the first roller 441 may sequentially move along the main slot 401, the first branch slot 410, the second branch slot 420, and the main slot 401. In detail, the first roller 441 may enter the one end portion 411 of the first branch slot 410 from one end portion 4011 of the main slot 401, move along the first branch slot 410, press the blocking lever 480 to enter the other end portion 422 of the second branch slot 420 and move along the second branch slot 420, and again enter one end portion 4011 of the main slot 401 through one end portion 421 of the second branch slot 420.

As described above, the first switching lever 430 according to another example of the disclosure may allow the first roller 441 and the second roller 442 to enter the first and second branch slots 410 and 420, respectively, through the first elastic member 434 and the protrusion part 4321 without using a separate driving source. Therefore, the stapler 100 may move while rotating at various angles.

In addition, the first roller 441 entering the second branch slot 420 by pressing the blocking lever 480 moves together with the second roller 442 along the second branch slot 420, such that it may move in the horizontal direction extended from the main slot 401.

Again referring to FIG. 12, an extension slot 600 extended from the other end portion 4012 of the main slot 401 is formed at the other end portion 4012 of the main slot 401 opposed to one end portion 4011 of the main slot 401.

A second switching lever 500 may be rotatably disposed in the extension slot 600.

The second switching lever 500 may have opposite end portions in selective contact with inner sidewalls of the extension slot 600 to partition the extension slot 600 into a first branch slot 610 and a second branch slot 620, and may rotate around a shaft 530 disposed at the center thereof.

Since the second switching lever 500 partitioning the extension slot 600 into the first and second branch slots 610 and 620 rotates in the extension slot 600, shapes of spaces occupied by the first and second branch slots 610 and 620 may be changed depending on rotation of the second switching lever 500.

FIGS. 14A to 14D are enlarged views of a form in which the first and second rollers 441 and 442 move along the first and second branch slots 610 and 620 partitioned through a second switching lever 500.

The extension slot 600 may include first to sixth inner sidewalls 601 to 606 sequentially connected to each other, the first inner sidewall 601 is connected to one sidewall of the other end portion 4012 of the main slot 401, the second inner sidewall 602 is connected to the first inner sidewall 601 in a state in which it is bent at a predetermined angle, the third inner sidewall 603 is connected to the second inner sidewall 602 in a state in which it is bent, the fourth inner sidewall 604 is connected to the third inner sidewall 603 in a state in which it is bent, the fifth inner sidewall 605 is connected to the fourth inner sidewall 604 in a state in which it is bent, and the sixth inner sidewall 606 is connected to the fifth inner sidewall 605 in a state in which it is bent.

In addition, the sixth inner sidewall 606 is connected to the other sidewall facing one sidewall of the other end portion 4012 of the main slot 401, such that the main slot 401 and the extension slot 600 may be connected to each other as one space.

One end portion 510 of the second switching lever 500 may be disposed adjacently to the other end portion 4012 of the main slot 401, and rotate around the shaft 530 to selectively open or close the first and second branch slots 610 and 620.

In detail, one end portion 510 of the second switching lever 500 may rotate around the shaft 530 to be in selective contact with the first inner sidewall 601 and the sixth inner sidewall 606 of the extension slot 600 facing each other, thereby selectively opening or closing the first branch slot 610 and the second branch slot 620.

Figure 14A:
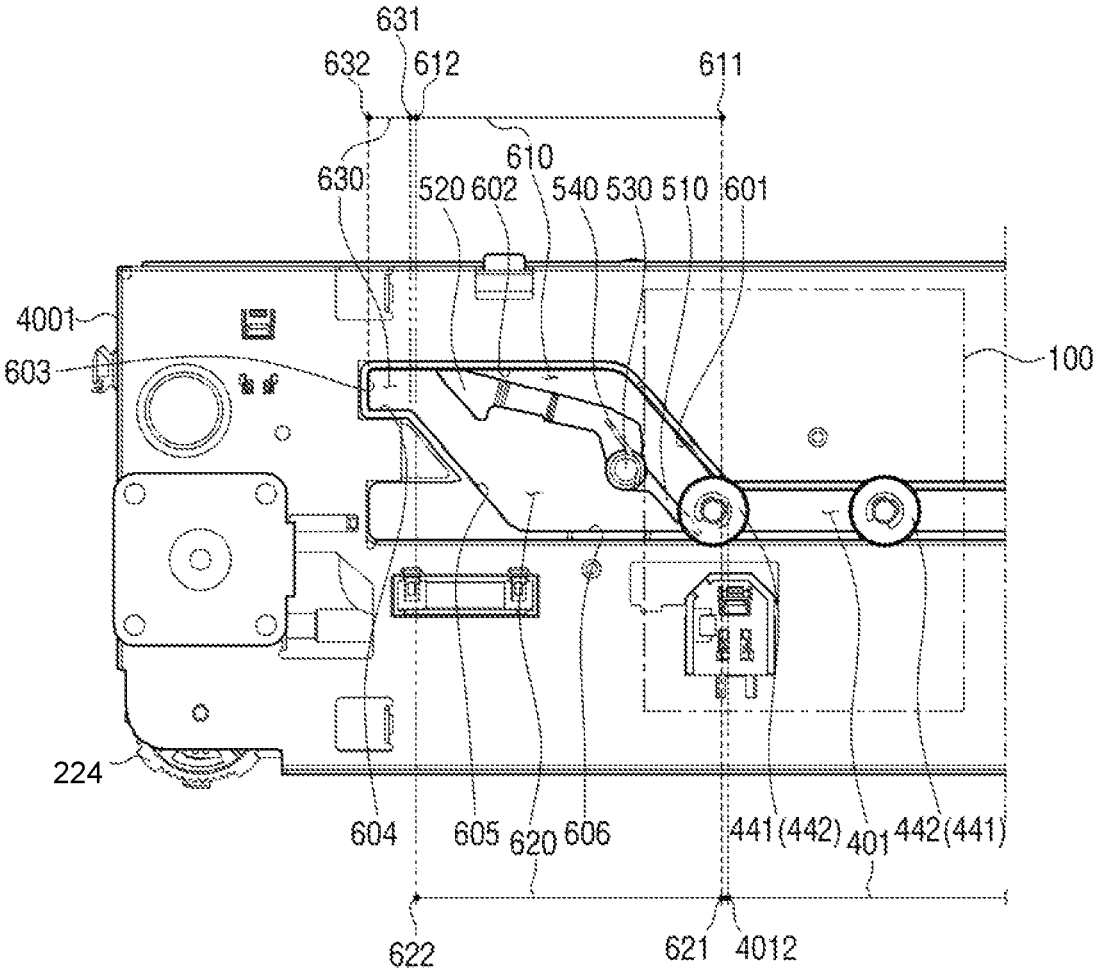
FIGS. 14A to 14D are enlarged views of a form in which the first and second rollers illustrated in FIG. 12 move along the first and second branch slots partitioned through a second switching lever.

As illustrated in FIG. 14A, one end portion 510 of the second switching lever 500 may be in contact with the sixth inner sidewall 606 to open the first branch slot 610 formed between the second switching lever 500 and the first and second inner sidewalls 601 and 602 from the main slot 401 and close the second branch slot 620. In this case, the other end portion 520 of the second switching lever 500 is in contact with the second inner sidewall 602.

A state in which the first branch slot 610 is opened and the second branch slot 620 is closed refers to a state in which the first roller 441 may enter one end portion 611 of the first branch slot 610 and may not enter one end portion 621 of the second branch slot 620.

A second elastic member 540 may be coupled to the shaft 530 of the second switching lever 500, and may apply force to the second switching lever 500 so that one end portion 510 of the second switching lever 500 rotates in a first direction in which it closes the second branch slot 620.

Therefore, as illustrated in FIG. 14A, the first roller 441 may enter one end portion 611 of the opened first branch slot 610 from the other end portion 4012 of the main slot 401.

Figure 14B:
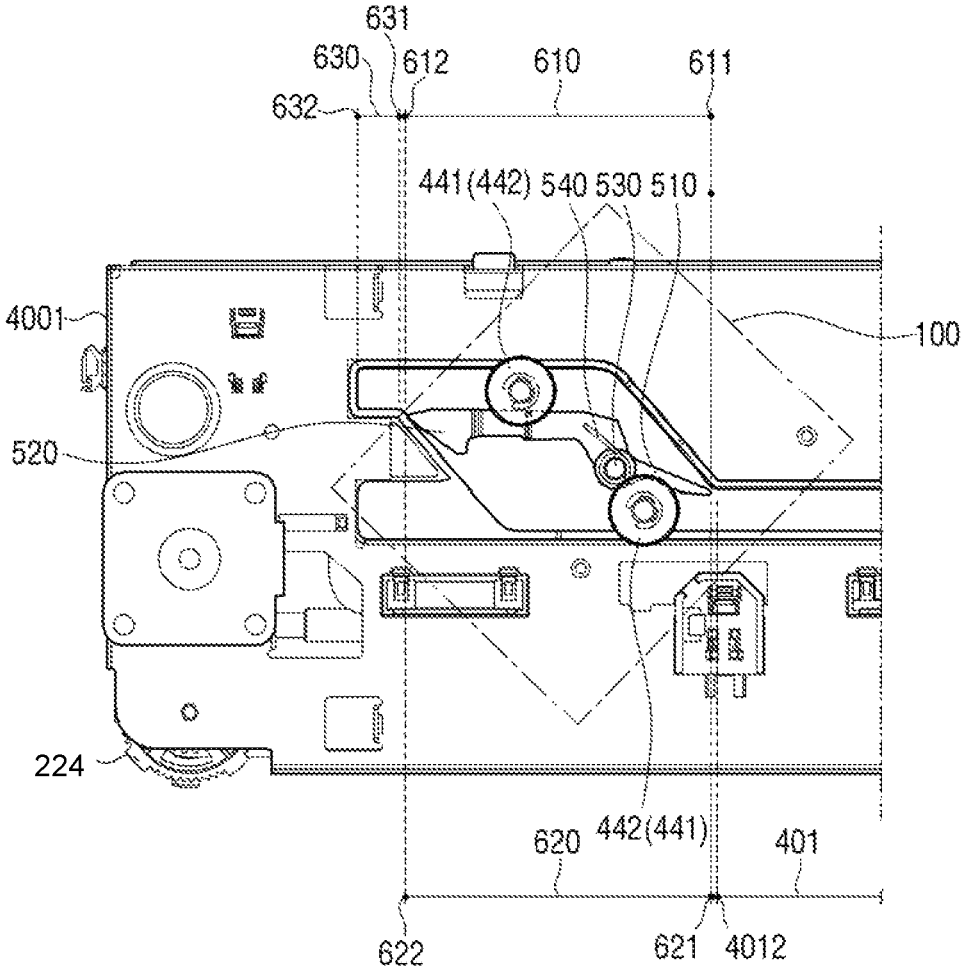

In addition, as illustrated in FIG. 14B, the first roller 441 moving along the first branch slot 610 presses the other end portion 520 of the second switching lever 500, such that the second switching lever 500 may rotate in a second direction in which it closes the first branch slot 610.

Since the second branch slot 620 is opened while the first roller 441 presses the other end portion 520 of the second switching lever 500, the second roller 442 following the first roller 441 enters one end portion 621 of the second branch slot 620.

Therefore, the first roller 441 moves along the first branch slot 610, and the second roller 442 moves along the second branch slot 620, such that the stapler 100 may move in a state in which it is inclined at a predetermined angle.

In addition, the extension slot 600 further may include an accommodating groove 630 disposed adjacently to the other end portion 520 of the second switching lever 500.

As illustrated in FIG. 14A, the accommodating groove 630 may be partitioned by a portion of the second inner sidewall 602, the third inner sidewall 603, and the fourth inner sidewall 604, and is formed so that the first roller 441 may be inserted thereinto.

As illustrated in FIG. 14B, as the first roller 441 presses the other end portion 520 of the second switching lever 500 while moving along the first branch slot 610, the second switching lever 500 maintains a state in which it rotates in the second direction, such that the other end portion 520 of the second switching lever 500 may be in contact with the fifth inner sidewall 605. Therefore, the first branch slot 610 and the accommodating groove 630 may be connected to each other.

Therefore, the first roller 441 moving along the first branch slot 610 may pass through the other end portion 612 of the first branch slot 610, and then move to the accommodating groove 630 through one end portion 631 of the accommodating groove 630.

Figure 14C:
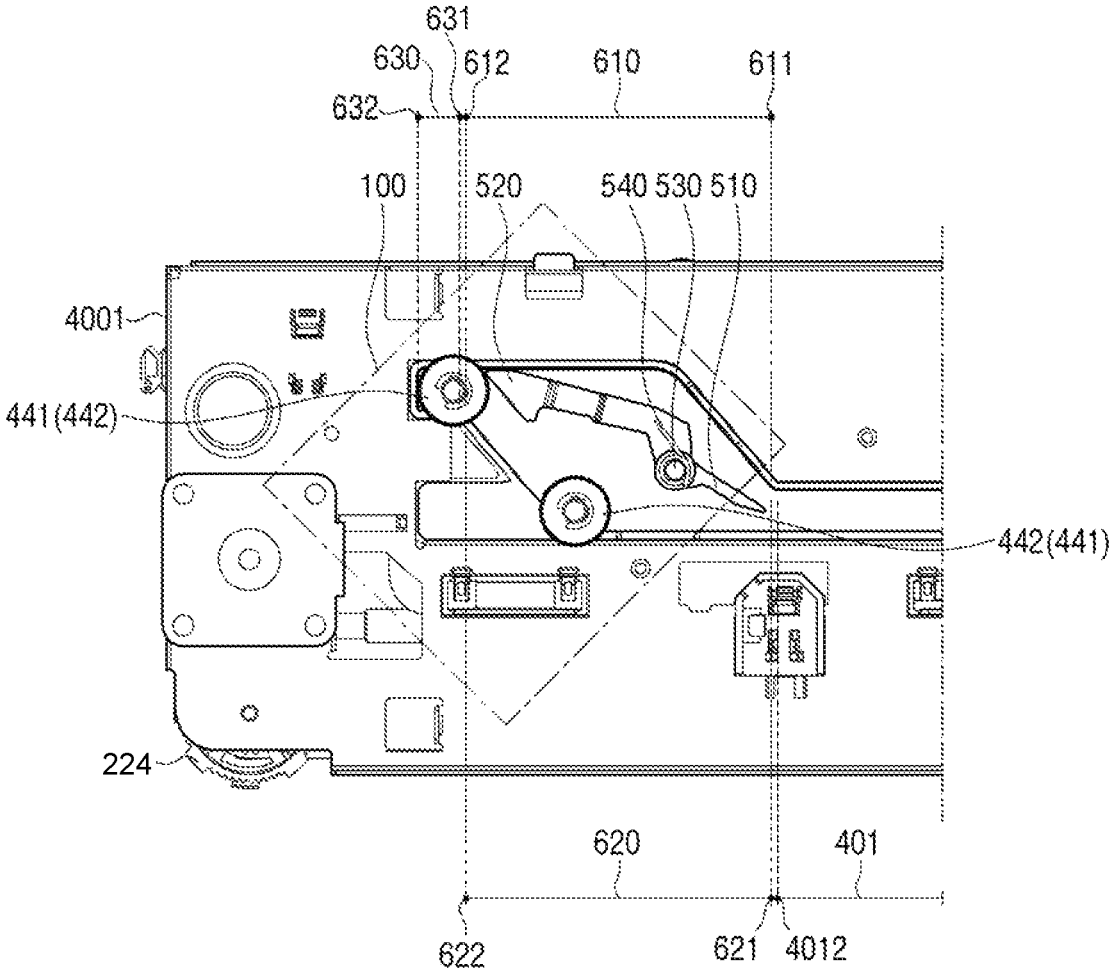

As illustrated in FIG. 14C, when the first roller 441 moves up to the other end portion 632 of the accommodating groove 630 to be accommodated in the accommodating groove 630, the first roller 441 and the other end portion 520 of the second switching lever 500 are spaced apart from each other.

Therefore, the other end portion 520 of the second switching lever 500 is released from being pressed from the first roller 441, such that the second switching lever 500 rotates in the first direction in which it closes the second branch slot 620 by the force applied by the second elastic member 540.

When the second switching lever 500 rotates in the first direction, the other end portion 520 of the second switching lever 500 is again in contact with the second inner sidewall 602, such that the accommodating groove 630 and the second branch slot 620 may be connected to each other.

The accommodating groove 630 and the second branch slot 620 are connected to each other as described above, such that the first roller 441 accommodated in the accommodating groove 630 may move together with the second roller 442 along the second branch slot 620 via the other end portion 622 of the second branch slot 620.

Figure 14D:
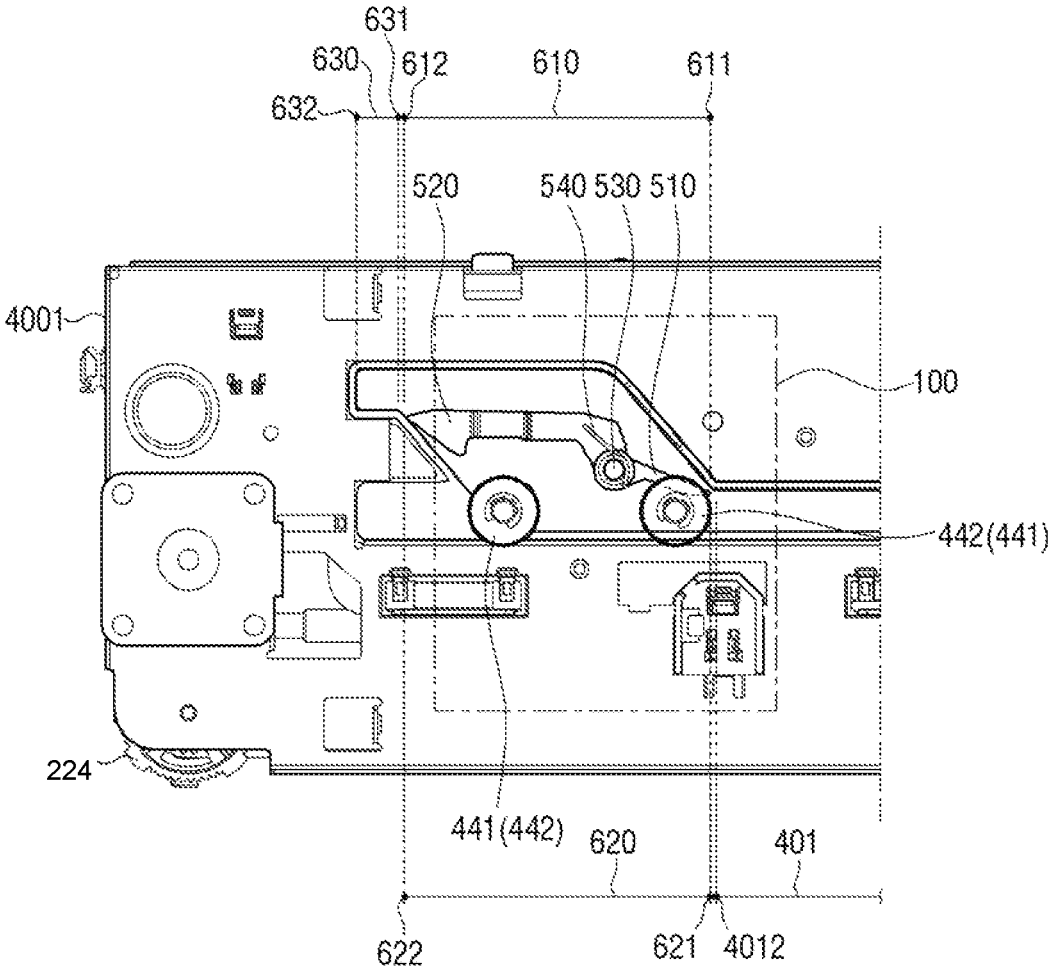

As illustrated in FIG. 14D, the first roller 441 moving toward the main slot 401 along the second branch slot 620 may follow the second roller 442.

In the first and second rollers 441 and 442 moving along the second branch slot 620, the second roller 442 may press one end portion 510 of the second switching lever 500 to open one end portion 621 of the second branch slot 620, enter the main slot 401 through the other end portion 4012 of the main slot 401, and move along the main slot 401.

As described above, the extension slot 600 is partitioned into the first branch slot 610 and the second branch slot 620 through a single second switching lever 500, and the first branch slot 610 and the second branch slot 620 are selectively opened or closed through the rotation of the second switching lever 500, such that a moving path and an angle of the stapler 100 may be variously adjusted. As a result, the stapling apparatus 30 may be configured in a more compact structure.

In addition, the first roller 441 moves from the first branch slot 610 to the second branch slot 620 through the accommodating groove 630, such that the first roller 441 and the second roller 442 move together with each other along the second branch slot 620. As a result, the stapler 100 may move in the horizontal direction extended from the main slot 401.

Although examples of the disclosure have been individually described hereinabove, the examples are not necessarily implemented respectively, but may also be implemented so that configurations and operations thereof may be combined with another example.

Although examples of the disclosure have been illustrated and described hereinabove, the disclosure is not limited to the examples described above, but may be variously modified to which the disclosure pertains without departing from the scope and spirit of the disclosure as claimed in the claims. These modifications should also be understood to fall within the technical spirit and scope of the disclosure.

The invention claimed is:

1. A stapling apparatus comprising:
a stapler;
a driver to move the stapler; and
a guide part to define a moving path, among a plurality of paths, along which the stapler is to move, in response to selection of the moving path, through a switching lever to open or close a path of the plurality of paths.

2. The stapling apparatus as claimed in claim 1, wherein the guide part includes:
a main slot to define a main moving path of the moving path, the main slot having a first end portion,
a first branch slot to be connected to the first end portion of the main slot to be branched from the first end portion of the main slot, to define a first branch path among the plurality of paths, and
a second branch slot to be connected to the first end portion of the main slot to be branched from the first end portion of the main slot, to define a second branch path among the plurality of paths, and
the switching lever to selectively open or close the first branch slot or the second branch slot, to define the moving path.

3. The stapling apparatus as claimed in claim 2, wherein the guide part includes first and second rollers to be coupled to the stapler and to be slidably inserted into the main slot.

4. The stapling apparatus as claimed in claim 3, wherein the first branch slot is inclined with respect to the main slot.

5. The stapling apparatus as claimed in claim 4, wherein the first branch slot includes at least one bent slot section.

6. The stapling apparatus as claimed in claim 3, wherein the second branch slot extends in a same direction as a main direction along which the main slot extends.

7. The stapling apparatus as claimed in claim 3, wherein
the switching lever is to rotate about a shaft so that a first portion of the switching lever selectively opens or closes the first branch slot or the second branch slot connected to the first end portion of the main slot, and
the shaft is disposed at a second portion of the switching lever.

8. The stapling apparatus as claimed in claim 7, wherein the guide part includes a rotation driving unit to rotate the switching lever.

9. The stapling apparatus as claimed in claim 8, wherein the guide part includes
a third branch slot to be connected to a second end portion of the main slot, to be branched from the second end portion of the main slot, to define a third branch path among the plurality of paths,
a fourth branch slot to be connected to the second end portion of the main slot, to be branched from the second end portion, to define a fourth branch slot among the plurality of paths, and
a second switching lever to selectively open or close the third branch slot or the fourth branch slot, to define the moving path.

10. The stapling apparatus as claimed in claim 8, further comprising a controller to control the rotation driving unit to rotate the switching lever in a direction in which the switching lever closes the first branch slot when one of the first roller or the second roller enters the first branch slot.

11. The stapling apparatus as claimed in claim 7, wherein the first roller is disposed in front of the second roller in a moving direction of the stapler, and the first and second rollers are to move along the first and second branch slots, respectively.

12. The stapling apparatus as claimed in claim 11, wherein the switching lever includes:

an elastic member to apply a force to the switching lever so that the switching lever rotates in a first direction to close the second branch slot, and a protrusion part to protrude from the second portion of the switching lever toward an inner side of the first branch slot, and the protrusion part is to be pressed by the first roller entering the first branch slot, such that the switching lever rotates in a second direction to close the first branch slot.

13. The stapling apparatus as claimed in claim 12, wherein the first branch slot and the second branch slot are connected to each other to form a closed loop, and the first roller sequentially moves along the main slot, from the main slot to the first branch slot, from the first branch slot to the second branch slot, and from the first branch slot to the main slot.

14. The stapling apparatus as claimed in claim 13, wherein the guide part includes a blocking lever to open or close a portion of the first branch slot or a portion of the second branch slot, to block the first roller from entering the first branch slot from the second branch slot.

15. A stapling apparatus, comprising:

a stapler;

a driver to move the stapler; and a guide part to define a moving path, among a plurality of moving paths, along which the stapler is to move, in response to selection of the moving path, the guide part including:

a main slot to define a main path among the plurality of moving paths, an extension slot to be extended from the main slot, to define an extension path among the plurality of moving paths, and a switching lever to be rotatably disposed in the extension slot to partition the extension slot into a first branch slot and a second branch slot, to define a first branch path and a second branch path, among the plurality of moving paths.

* * * * *